US010174440B2

(12) United States Patent
Sevenhuysen et al.

(10) Patent No.: US 10,174,440 B2
(45) Date of Patent: Jan. 8, 2019

(54) **TEXTILE FIBRES AND TEXTILES FROM *BRASSICA* PLANTS**

(71) Applicant: University of Manitoba, Winnipeg (CA)

(72) Inventors: Gustaaf Peter Sevenhuysen, Winnipeg (CA); Mashiur Rahman, Winnipeg (CA)

(73) Assignee: University of Manitoba, Winnipeg (CA)

( * ) Notice: Subject to any disclaimer, the term of this patent is extended or adjusted under 35 U.S.C. 154(b) by 131 days.

(21) Appl. No.: 15/022,909

(22) PCT Filed: Sep. 18, 2014

(86) PCT No.: PCT/CA2014/050892

§ 371 (c)(1),
(2) Date: Mar. 17, 2016

(87) PCT Pub. No.: WO2015/039243

PCT Pub. Date: Mar. 26, 2015

(65) Prior Publication Data

US 2016/0222545 A1 Aug. 4, 2016

Related U.S. Application Data

(60) Provisional application No. 61/881,324, filed on Sep. 23, 2013.

(51) Int. Cl.

| | |
|---|---|
| ***D01C 1/02*** | (2006.01) |
| ***D02G 3/02*** | (2006.01) |
| ***D06P 3/66*** | (2006.01) |
| ***D06M 16/00*** | (2006.01) |
| ***D01B 1/10*** | (2006.01) |
| ***D04H 3/015*** | (2012.01) |
| ***D04H 1/425*** | (2012.01) |

(52) U.S. Cl.

CPC ..... *D01C 1/02* (2013.01); *D01B 1/10* (2013.01); *D02G 3/02* (2013.01); *D04H 3/015* (2013.01); *D06M 16/003* (2013.01); *D06P 3/66* (2013.01); *D04H 1/425* (2013.01); *D10B 2201/01* (2013.01); *D10B 2401/14* (2013.01); *D10B 2401/20* (2013.01)

(58) Field of Classification Search

CPC ... D01C 1/02; D02G 3/02; D06P 3/66; D06M 16/003; D01B 1/10; D04H 3/015; D04H 1/425; D10B 2201/01; D10B 2401/14; D10B 2401/20

See application file for complete search history.

(56) References Cited

U.S. PATENT DOCUMENTS 6,165,769 A * 12/2000 Andersen ..... C12N 9/2465 435/183
2007/0199669 A1* 8/2007 Yang ..... D21C 3/02 162/90

FOREIGN PATENT DOCUMENTS

DE 29917928 * 5/2001

OTHER PUBLICATIONS

Kopania et al., "Studies on Isolation of Cellulose Fibres from Waste Plant Biomass", Fibres & Textiles in Eastern Europe, vol. 20, No. 6B(96), pp. 167-172, 2012.*
Kopania et al., "Studies on Isolation of Cellulose Fibres from Waste Plant Biomass", Fibres & Textiles in Eastern Europe, vol. 20, No. 613(96), pp. 167-172, 2012.

* cited by examiner

*Primary Examiner* — Amina S Khan
(74) *Attorney, Agent, or Firm* — Winstead PC

(57) ABSTRACT

Textile fibers and textiles produced from *Brassica* plants retain properties that are favorable for textile manufacture. Also described are textiles manufactured from the textile fibers produced from the *Brassica* plants which exhibit properties that are favorable for apparel and domestic applications, as well as industrial applications. Methods for producing the textile fibers from *Brassica* plants are further described.

9 Claims, 34 Drawing Sheets

TEXTILE FIBRES AND TEXTILES FROM *BRASSICA* PLANTS

FIELD OF THE INVENTION

The present invention relates to the field of textiles made from plant materials and, in particular, to textile fibres and textiles produced from *Brassica* plants.

BACKGROUND OF THE INVENTION

Plant fibre materials have been utilized for many years to produce textile from which a wide variety of fabrics can be manufactured, for example. Such plant fibre materials continue to grow in demand with the growing demand for natural materials and products. To keep up with this demand, various plant fibre materials from a wide range of sources have been explored for properties that are favourable for use in textile manufacturing. For example, textile properties such as uniformity, flexibility, fineness, cohesiveness, tenacity, absorbency, pliability, and amenability to various textile processing and/or treatments, must be met before a plant fibre material can be used for textile applications.

The fibres of plants, including hemp, flax, jute, nettle, ramie and the like, are known to have such properties and have been utilized for a wide variety of different textiles. For example, grass, rush, hemp, and sisal are used in making rope. Coir (coconut fibre) is used in making twine, mats, and sacking. Fibres from pulpwood trees, cotton, rice, hemp, and nettle are used in making paper. Cotton, flax, jute, hemp, ramie, bamboo, and even pineapple fibre are used in clothing.

One plant which has not heretofore been utilized for the production of textiles is the rape plant, which are plants in the genus *Brassica*. The most commonly recognized variety of the rape plant is the low erucic acid and low glucosinolate variety known as canola, rapeseed 00, or double zero rapeseed. There are many species of rape plants that fall within the genus *Brassica*, all of which are collectively referred to herein as canola plants.

As the third largest source of vegetable oil and the second leading source of protein meal, canola is one of the world's main oilseed crops. World production is growing rapidly, with the Food and Agriculture Organization (FAO) reporting 36 million tons of rapeseed produced in the 2003-2004 season, and estimating 58.4 million tons in the 2010-2011 season. In Canada alone, production of canola rose from 9 million tons in 2006 to over 10 million tons by 2008.

Despite rapidly growing world production of canola, the canola plant itself has no value as it is the oilseed alone that is the valuable harvested component of the crop. Canola is only grown as a source for the two sub-products, canola oil and canola meal. The tiny round canola seeds are crushed to produce oil, and the remainder is processed into meal, which can be used as a high-protein meal. Canola is also used for biodiesel production. As a result, approximately 40 million tons of canola stalks are available after harvesting. This by-product material is considered waste and is typically ploughed back into the soil, burned, or used as animal bedding. Commercial application of this canola by-product would, therefore, be desirable to maximizing the economy of this valuable resource.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

Disclosed herein are exemplary embodiments pertaining to textile fibres and textiles such as yarns and fabrics produced from *Brassica* plants. An exemplary embodiment of the present disclosure relates to a textile fibre produced from *Brassica* plant material. In accordance with another aspect of the disclosure, there is described a textile fibre produced from *Brassica napus*. According to one embodiment, the textile fibre described herein is dyeable. According to another embodiment, the textile fibre described herein is colourfast. According to a further embodiment, the textile fibre described herein has a moisture regain of up to about 20% to about 30%. According to another embodiment, the textile fibre described herein is heat resistant to temperatures of up to about 250° C.

In accordance with a further aspect of the disclosure, there is described a textile manufactured from the textile fibre produced from *Brassica* plants according to the present disclosure. According to one embodiment, the textile is fabric. According to another embodiment, the textile is spun yarn.

In accordance with another aspect of the disclosure, there is described a use of *Brassica* plant material for producing a textile fibre.

In accordance with a further aspect of the disclosure, there is described a method for producing a textile fibre from *Brassica* plant material, the method comprising: a. retting *Brassica* plant material to produce plant fibre; and b. treating the plant fibre to any one or a combination of treatments selected from the group consisting of enzyme treating, scouring, bleaching, dyeing, and softening.

BRIEF DESCRIPTION OF THE DRAWINGS

These and other features of the invention will become more apparent in the following detailed description in which reference is made to the appended drawings.

DETAILED DESCRIPTION OF THE INVENTION

Figure 1:
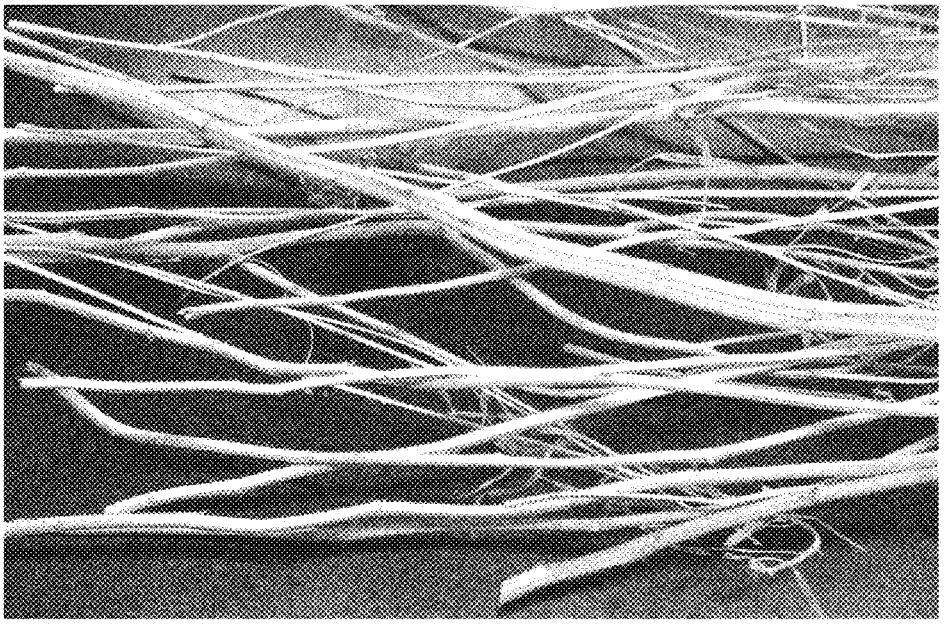
FIG. 1 is a photograph of harvested mature *Brassica napus* plant material.

The canola plant itself is considered to be a by-product of canola production that has no downstream commercial value once the oil-seed has been harvested. In accordance with embodiments of the present disclosure, plant material from the canola plant has been given commercial application in the manufacture of textiles. Specifically, it has been found that extracted plant material from *Brassica* can be treated to produce plant fibres which can be further processed into textile fibres. The textile fibres produced from *Brassica* plant fibres, according to embodiments of the present disclosure, have been found to exhibit properties that are favourable for manufacturing spun yarn which can then be utilized in the manufacture of woven, knitted, and non-woven textile products. These manufactured woven, knitted, and non-woven textile products, according to embodiments of the present disclosure, exhibit properties that may be suitable for a wide range of applications including domestic, industrial, and medical applications. Without limiting the foregoing, textile fibres according to the present disclosure may be used in the manufacture of apparel (woven and knitted) and technical or smart textiles (e.g., woven and knitted bandage). Carded web can be produced to make non-woven fabrics.

The production of *Brassica* plant fibres, according to embodiments of the present disclosure, can be achieved using methods known in the art. For example, according to certain embodiments, the plant fibre of the present disclosure can be produced by a retting process to yield bast fibres. According to embodiments of the present disclosure, processing of *Brassica* plant materials to produce bast fibres for use in the manufacture of textile fibres can be achieved using methods known in the art and thus may not require special and cost-intensive processing techniques.

Bast fibres are natural cellulosic fibres extracted from plant stalk (e.g., hemp, flax, jute) and are known to possess some excellent properties over widely used fibres such as cotton and polyester, for example. Such properties include faster transport of moisture, higher hygroscopicity, greater protection from ultra violet, and high absorbability of toxic gases (Muzyczek, M. 2012. The use of flax and hemp for textile applications. In Handbook of natural fibers. ed. R. Kozlowski. Vol. 2, 312-327. USA: Woodhouse Publishing). Due to the presence of non-cellulosic materials (≈25-37%) in their structures, however, bast fibres are considered to lack the properties required to allow these fibres to be processed into textile fibres that can be used to produce high quality finer yarns that may be used in apparel and smart textiles, for example. These properties are known in the art as spinning properties.

Currently the spinning properties of known bast fibres, such as hemp, flax, and jute, are such that only coarse and low quality yarns can be produced for uses such as cordage, ropes and other niche applications. According to embodiments of the present disclosure, bast fibres produced from *Brassica* can be processed to produce textile fibres having spinning properties that are suitable for manufacturing finer yarns that may be used in apparel and smart textiles, for example. In other embodiments, the bast fibres produced from *Brassica* can be processed to produce textile fibres having spinning properties that are suitable for cotton spinning systems. In a further embodiment, the bast fibres produced from *Brassica* can be processed to produce textile fibres having spinning properties that are suitable for ring or rotor spinning systems.

Definitions

Unless defined otherwise, all technical and scientific terms used herein have the same meaning as commonly understood by one of ordinary skill in the art to which this invention belongs.

As used herein, the terms "plant fibre", "bast fibre", "extracted fibre", "virgin fibre" or "raw fibre" may be used interchangeably to refer to fibre produced from a *Brassica* plant. The plant fibre can be produced from *Brassica* using methods known in the art. According to preferred embodiments, the plant fibre is retted and/or conditioned fibre produced from a *Brassica* plant. The retted and/or conditioned fibre can further be processed to produce "textile fibres".

The term "textile fibre", as used herein, refers to plant fibres produced from *Brassica* that have been further processed to achieve properties that are suitable for the manufacture of a textile. According to certain embodiments, the textile fibre may be processed to exhibit spinning properties. In particular, the textile fibre may be processed to exhibit properties suitable for spinning the textile fibre into a yarn by various methods including twisting, or made into a fabric by weaving, knitting, bonding (non-woven from carded webs), and braiding. Textile fibres according to embodiments of the present disclosure form the basic unit of the textile structures described herein.

The term "textile", as used herein, refers to a material made from a network of textile fibres produced from a *Brassica* plant. Such materials include, without limitation, carded webs, yarns, and fabrics, and products made from such webs, yarns, and fabrics, which retain more or less completely the properties of the original textile fibres. The term further includes embodiments comprising textile fibres produced from a *Brassica* plant in combination with one or more other type of fibre including natural and/or synthetic fibres known in the art.

The term "yarn", as used herein, refers to a textile formed as a thin, long, continuous twisted strand suitable for knitting, weaving, or otherwise intertwining to form a textile fabric, for example.

As used herein, the term "fabric" refers to a manufactured assembly of textile fibres that is generally in a woven or non-woven sheet-like form and having sufficient mechanical strength to give the assembly inherent cohesion. Fabrics can be manufactured by any number of methods known in the art including, without limitation, weaving, knitting, lace binding, braiding, and bonding.

As used herein, the term "about" refers to an approximately +/−10% variation from a given value. It is to be understood that such a variation is always included in any given value provided herein, whether or not it is specifically referred to.

Production of Textile Fibres from *Brassica*

According to embodiments of the present disclosure, *Brassica* plant material is treated to produce *Brassica* plant fibres that can be further processed to produce textile fibres that can be utilized to form a textile. Textile fibres produced from *Brassica* plant fibres can be processed to form textile products such as carded web, yarn or fabric that can ultimately be used to make a variety of textile products, examples of which include without limitation, clothing, handbags, bags, rope, covers, bedding and a wide variety of other textile products.

*Brassica* plant fibres can be produced from green and/or mature plant material using methods known in the art. For example, in one embodiment retting methods for treating plant material can be used to produce the *Brassica* plant fibre having properties favourable for the manufacture of textile fibres which can produce carded web for non-woven fabrics, yarns and woven and knitted fabrics of commercial value. As discussed above, it is contemplated that the source of *Brassica* plant fibre according to embodiments of the present disclosure is by-product plant material from canola-seed production. According to embodiments of the present disclosure, therefore, plant material including stem material is treated to produce plant fibre suitable for textile production. In other embodiments, the plant stem is treated to produce plant fibre suitable for textile production. In further embodiments, the entire plant is treated to produce plant fibre suitable for textile production.

As is known by those skilled in the art, retting involves the separation of the plant fibres (otherwise known as bast fibres) from the woody core of the plant stalk. Specifically, retting is a process of rotting away the inner plant stalk to leave the outer bast fibres intact. Retting is accomplished by micro-organisms either on land or in the water or by using chemicals or pectinolytic enzymes. The most common method of retting comprises placing the plant material to be retted in a pond, stream, field or tank and exposing the material to water for a sufficient amount of time to allow the water to penetrate the central stalk portion, swell the inner cells and burst the outermost layer, thereby exposing the inner core to decay-producing bacteria that will rot away the inner stalk and leave the outer fibres intact, a procedure known as decortification. In one embodiment, *Brassica* plant material is treated by water retting to produce *Brassica* plant fibres that can be further processed to produce textile fibres. In another embodiment, *Brassica* plant material is treated by alkali retting to produce *Brassica* plant fibres that can be processed to form textile fibres. In a further embodiment,

*Brassica* plant material is treated by acid retting to produce *Brassica* plant fibres that can be processed to form textile fibres. In another embodiment, *Brassica* plant material is treated by enzyme, for example pectinase, retting to produce *Brassica* plant fibres that can be processed to form textile fibres.

Once produced, the plant fibre is then washed and dewatered to produce the *Brassica* plant fibre that can then be further treated to produce textile fibres according to embodiments of the present disclosure. In certain embodiments, the plant fibres can be processed to achieve properties in the resulting textile fibre suitable for spinning. In one embodiment, the plant fibres are chemically treated to achieve spinning properties in the resulting textile fibre. According to some embodiments, the chemical treatment involves one or a combination of enzyme (pectinase), scouring, softening, bleaching, and/or reactive or blank dyeing treatments.

According to one embodiment, treatment of *Brassica* plant fibre to produce textile fibre, comprises a combination of scouring, and softening, the plant fibre. According to another embodiment, treatment of *Brassica* plant fibre to produce textile fibre, comprises a combination of scouring, bleaching, and softening the plant fibre. According to a further embodiment, treatment of *Brassica* plant fibre to produce textile fibre, comprises a combination of scouring, bleaching, and dyeing the plant fibre.

The resulting textile fibres can be utilized to form yarn, thread, fleece or the like using methods known to those skilled in the art. For example, textile comprising the *Brassica* textile fibre can be converted into spun yarn which then according to the present disclosure can be processed into the desired fabric by weaving, knitting, crocheting, bonding, pressing or by other known processes or combinations thereof as applicable for the fabric.

Properties of *Brassica* Textile Fibres

To be utilized for the manufacture of textiles, textile fibres must possess and retain certain properties when produced from plant material as it is these retained properties that will determine the quality and type of textile that can be manufactured from the textile fibre. The primary properties that are considered for determining the usability of a textile fibre for the manufacture of textiles depends on the planned end-use of the fibre and can include, for example, one or more of the following exemplary properties, fibre length to width ratio, fibre uniformity, fibre strength and flexibility, fibre extensibility and elasticity, thermal characteristics and fibre cohesiveness. Secondary properties can include, for example, moisture absorption characteristics, fibre resiliency, abrasion resistance, density, luster, chemical resistance, and flammability.

The particular properties that a textile fibre exhibits will not only determine its usability for the manufacture of textiles, but will also determine the properties that the textile will possess, such as the aesthetics, durability, comfort, and safety of the textile for its particular use. Accordingly, textile fibres must meet certain performance requirements to be considered usable for specific types of textiles. For example, textiles used for the manufacture of apparel, or other domestic applications, require fibres to meet certain specific requirements. These requirements may change depending on the particular application, however, the requirements for apparel textiles are exemplified in Table 1. If a fibre lacks a certain property, however, the fibre may be blended with other fibres to improve its properties. For example, by blending cotton (having elongation at break of 3-7%) with polyester, the elongation property can be increased to 12-55%.

TABLE 1

| Apparel/Domestic Requirements (single source fibre) | |
|---|---|
| PROPERTY | |
| Tenacity | 3-5 gram per denier |
| Elongation at break | 10-35% |
| Recovery from elongation | 100% at strains up to 5% |
| Modulus of elasticity | 30-60 gram per denier |
| Moisture absorbency | 2-5% |
| Zero strength temperature (excessive creep and softening point) | above 215° C. |
| High abrasion resistance (varies with type fabric structure) | |
| Dye-able | |
| Low flammability | |
| Insoluble with low swelling in water, in moderately strong acids and bases and conventional organic solvents from room temperature to 100° C. | |
| Ease of care | |

Similarly for industrial applications, certain specific requirements must also be met and may vary depending on the specific application. Exemplary industrial textile requirements are shown in Table 2.

TABLE 2

| Industrial Requirements | |
|---|---|
| PROPERTY | |
| Tenacity | 7-8 gram per denier |
| Elongation at break | 8-15% |
| Recovery from elongation | 100% at strains up to 5% |
| Modulus of elasticity | 80 gram per denier or more conditioned, 50 gram per denier wet |
| Zero strength temperature | 250° C. or above |

The textile fibres produced from *Brassica* plant material, according to the embodiments of the present disclosure, have been found to exhibit and retain one or more of the textile properties that are conducive to the manufacture of textiles. In certain embodiments, the *Brassica* textile fibres of the present disclosure possess and retain one or more of the textile properties that meet the requirements for apparel and/or domestic applications. In other embodiments, the *Brassica* textile fibres of the present disclosure possess and retain one or more of the textile properties that meet the requirements for industrial applications. In further embodiments, the *Brassica* textile fibres of the present disclosure possess and retain one or more of the textile properties that meet the requirements for woven textile applications. In other embodiments, the *Brassica* textile fibres of the present disclosure possess and retain one or more of the textile properties that meet the requirements for non-woven textile applications.

In particular embodiments of the present disclosure, the textile fibres produced from *Brassica* plant material can take up dye into the textile fibre. In this way, according to certain embodiments, the textile fibre of the present disclosure is dyeable and can be used for the manufacture of dyeable textile. In other embodiments, the textile fibre exhibits colourfastness and can be used to manufacture colourfast textiles.

In accordance with certain embodiments of the present disclosure, the textile fibres produced from *Brassica* plant material demonstrate heat resistance. According to one embodiment, the textile fibres produced from *Brassica* plant material demonstrate heat resistance to temperatures of up to about 250° C. According to other embodiments, the textile fibres produced from *Brassica* plant material demonstrate heat resistance to temperatures of up to about 100° C. to about 250° C. According to further embodiments, the textile fibres produced from *Brassica* plant material demonstrate heat resistance to temperatures of up to about 150° C. to about 200° C. According to other embodiments, the textile fibres produced from *Brassica* plant material demonstrate heat resistance to temperatures of up to about 200° C. to about 225° C. According to further embodiments, the textile fibres produced from *Brassica* plant material demonstrate heat resistance to temperatures of up to about 225° C. to about 250° C.

Textiles produced from *Brassica* textile fibres, according to embodiments of the present disclosure, therefore, exhibit relatively high decomposition temperatures. Accordingly, textile fibres according to the present disclosure exhibit thermal properties suitable for insulating textiles, for example. In some embodiments, therefore, the *Brassica* textile fibres produced according to the present disclosure can be used to manufacture insulating textiles.

In accordance with certain embodiments of the present disclosure, the textile fibres produced from *Brassica* plant material possess moisture regain properties. According to one embodiment, the textile fibres produced from *Brassica* plant material exhibit a hydration factor of up to about 30%. According to other embodiments, the textile fibres produced from *Brassica* plant material exhibit a hydration factor of between about 20% to about 30%. According to further embodiments, the textile fibres produced from *Brassica* plant material exhibit a hydration factor of between about 20% to about 25%. In other embodiments, the hydration factor of *Brassica* textile fibres according to the present disclosure can be up to about two times that of cotton. It is contemplated, therefore, that *Brassica* textile fibres according to the present disclosure can be used to manufacture high absorbency textiles such as wound dressings, for example.

In certain embodiments, the textile fibres of the present disclosure possess properties conducive to spinning of the textile fibres into various textiles, including yarns, carded webs, and woven or non-woven fabrics. In some embodiments the spinning properties of the textile fibres of the present disclosure are compatible with cotton spinning systems known to persons skilled in the art. In a further embodiment, the textile fibres derived from *Brassica* according to the present disclosure have spinning properties that are suitable for ring or rotor spinning systems operated according to methods known in the art.

Ring spinning is the most widely used short staple spinning process to produce superior quality (USTER TOP 5%) carded and combed yarns in a wide range of linear densities (2.0-1000 tex) using different fibres (Hatch, K (2006). Textile science. Revised ed. Apex NC: Tailored text custom publishing, p. 269). In order to produce combed yarn, ring spinning typically requires the following processes: opening, carding, drawing, combing (not required for carded yarn), drawing (not required for carded yarn), roving, and spinning. As is recognized by those skilled in the art, these processes can exert stress and tension on the textile fibres being processed. Accordingly, textile fibres must possess certain properties in order to be considered spinnable by such processes and, ultimately processable into higher quality carded and combed yarns. These spinning properties include, for example, length variation (±3 mm), fineness, softness, bending modulus, strength, and individual fibre entity.

The length variation in textile fibre length that is suitable for ring spinning is less than ±3 mm in order to withstand the stresses of the process. For example, it is known that fibre breakage and droppings occur when the variation in length of fibre is (L+3) mm and (L−3) mm respectively, where "L" refers to fibre length (Lord, P. 2003. Handbook of yarn production. Cambridge, England: Woodhead Publishing Limited). Variations in length outside of the ±3 mm range have been found to result in unevenness and imperfections in the yarn.

Textile fibre softness is also required for spinning processes in order to withstand both roller pressure and torsional pressure applied during the various stages of the spinning process and avoid fibre breakage.

As is known by those skilled in the art, more than 75% of yarn irregularities are produced due to fibre bundles made by self-entanglement or cluster with trash (Oschola, J., Kisato, J., Kinuthia, L., Mwasiahi, J. and Waithaka, A. 2013. Study on the influence of fiber properties on yarn imperfections in ring spun yarns, Asian Journal of Textile, 2(3), 32-43). Therefore, for better quality fabric the constituent yarn should be 'even' or ideally have a CVm % (coefficient of variation of yarn mass) of zero throughout the yarn length, i.e. where unevenness or imperfections of the yarn is expressed in terms of thick places (+d), thin places (−d) and neps (+d).

In a spun yarn, about 150 to 200 fibres are required in the cross-section along the length. If the fibres are in bundle form (more than one fibre and vary) then there will be more or fewer fibres in that specific place of the spun yarn resulting in thick and thin places. To illustrate, for example, in apparel applications (woven), top 5% USTER quality level requires that a 100% cotton combed ring spun yarn of 20 tex has about 10 (+50%) thick places per 1000 meter of yarn (USTER, 2007). About 10,000 meter yarn is required to make a woven t-shirt. Therefore, a high quality t-shirt can have only 10 (+ve 50%) thick places. Similarly, for the same quality t-shirt the acceptable number of thin places (−ve 50%) are fewer than 10 (USTER, 2007).

Further, imperfections (thick, thin and neps) in woven and knitted fabrics are determined by their size (+ve or −ve), as well as the length, of the faults. In Classimat yarn faults ('Classimat Faults'), the faults are classified according to length and diameter. For example, thick places are measured if the mean diameter of a yarn is exceeded by at least +100% in case of short faults (fault length<8 cm), which are A0, B0, C0 and D0 or by +45% in case of long faults (>8 cm) which are F and G faults (USTER Statistics, 2007). Without single fibre entity in the fibre, the ring spun yarn will contain numerous long classimat faults because of the total number of 'draft' (input material tex/output material tex) required to make this yarn. Textile fibres, therefore, should have a single fibre entity in order to minimize, or avoid, the occurrence of defects or faults that may result in the final woven or knitted product.

In one embodiment, the textile fibre produced from *Brassica* plant material exhibits a length variation comparable to cotton fibre. In a further embodiment, the textile fibre of the present disclosure exhibits a length variation suitable for ring spinning processes. In other embodiments, the textile fibre of the present disclosure exhibits a length variation of less than L±3 mm.

In some embodiments, the textile fibre produced from *Brassica* plant material exhibits single fibre entity. In further embodiments, the textile fibre produced from *Brassica* plant material exhibits a softness comparable to cotton. In other embodiments, the textile fibre of the present disclosure exhibits a softness suitable for ring spinning processes.

To gain a better understanding of the invention described herein, the following examples are set forth. It will be understood that these examples are intended to describe illustrative embodiments of the invention and are not intended to limit the scope of the invention in any way.

EXAMPLES

Example 1: Fibre Extraction 1.1 Plant Material

Manitoba based mature and green *Brassica napus* plants which were harvested on the outskirts of Winnipeg, Manitoba, Canada, were used.

The mature plants consisted of dried, straw/hay, and having a grassy smell. The outer layer of these mature plants was beige, thin and hard, brittle when removed, and difficult to separate manually while the middle layer was yellow, fibrous, stiff, woody appearance, textured, and visible fibre structures. The inner layer was white, foam-like core, firm but compressible and homogenous appearance. Some samples had black spots showing decay, disease or insect damage while few samples had purple colouring at the base of the stalk. The shape of the stalk varied from flat and wide to round with varying diameter. The stalks were very stiff and inflexible (FIG. 1).

1.2 Sample Cutting Procedure

Figure 2:
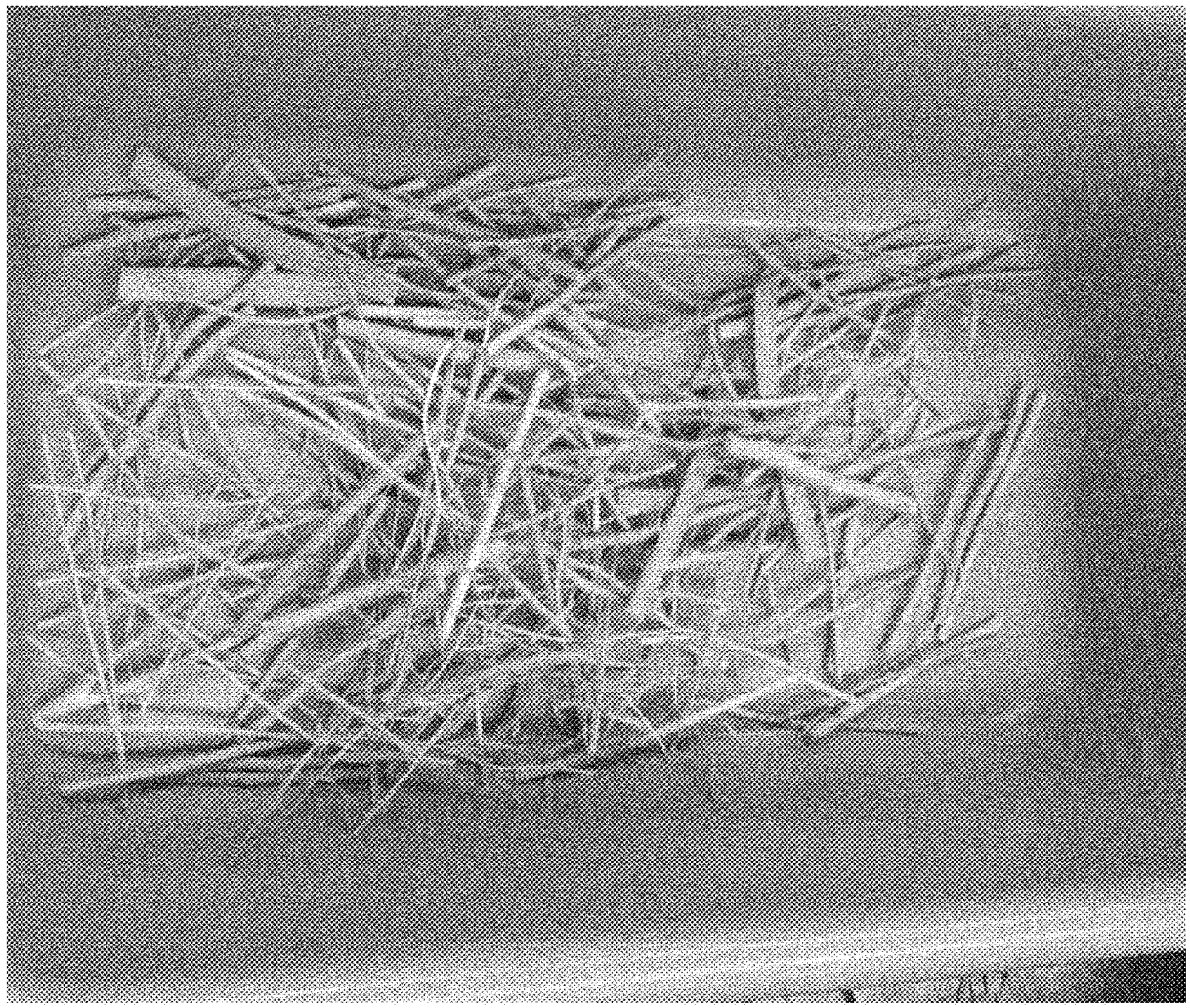
FIG. 2 is a photograph of cut mature *Brassica napus* plant material used for retting, according to embodiments of the present disclosure.

In order to prepare the samples, ¼-½" from each end of the whole sample was cut and removed from the plant. For retting purposes, 4" lengths of 180 samples were prepared from both mature and green *Brassica napus* plants and placed into separate labeled bins (FIG. 2). The cut samples were stored in the conditioning room at 21° C. and 65% relative humidity for 4 days.

1.3 Betting Procedures

Before proceeding with the retting process, samples were conditioned for at least 4 days and the weight of the plants was measured using gravimetric method.

Figure 3A:
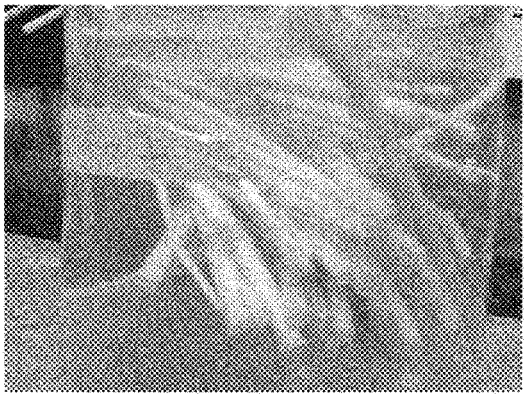
FIGS. 3A, 3B and 3C are close-up photographs of retting *Brassica napus* plant material according to embodiments of the present disclosure.
Figure 3B:
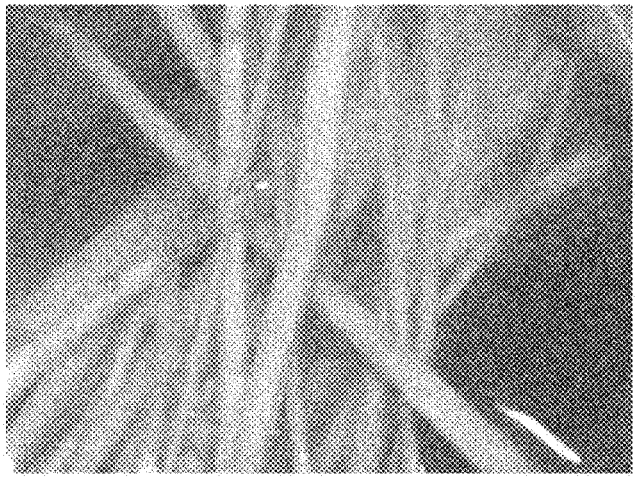
Figure 3C:
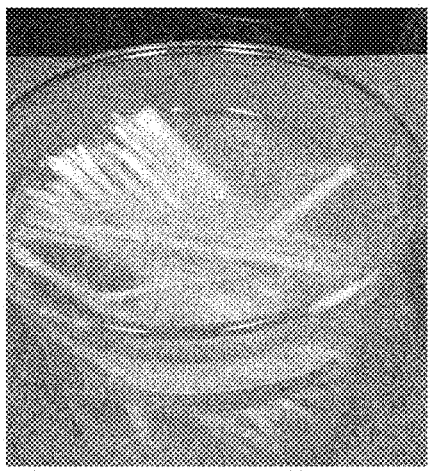
Figure 4A:
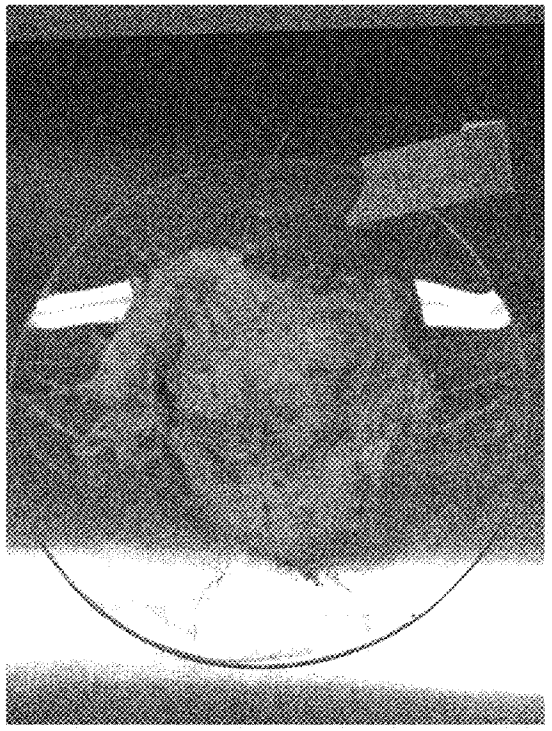
FIG. 4A is a photograph of a water retted plant fibre sample produced from mature *Brassica napus* plant material.
Figure 4B:
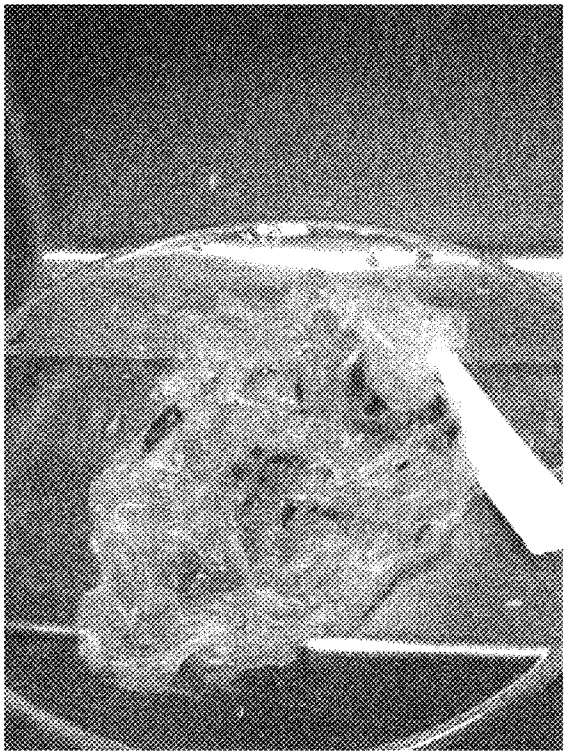
FIG. 4B is a photograph of a water retted plant fibre sample produced from green *Brassica napus* plant material, according to embodiments of the present disclosure.
Figure 5A:
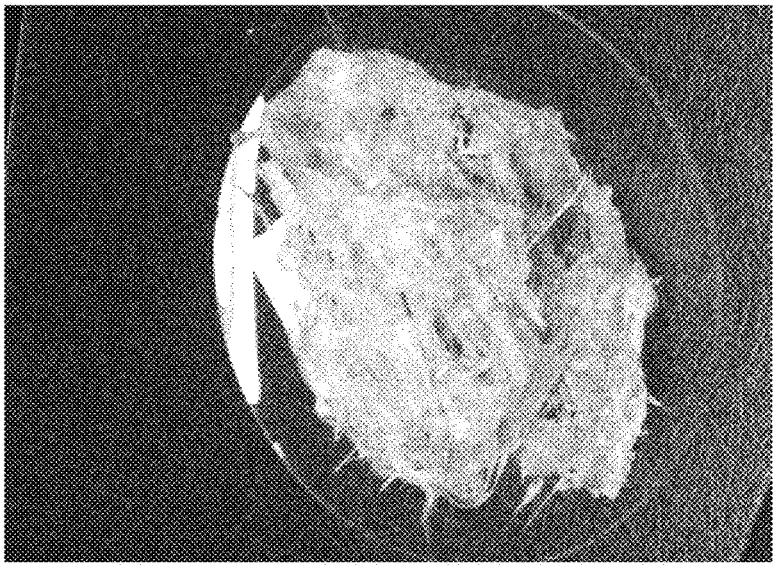
FIG. 5A is a photograph of an alkali retted plant fibre sample produced from green *Brassica napus* plant material.
Figure 5B:
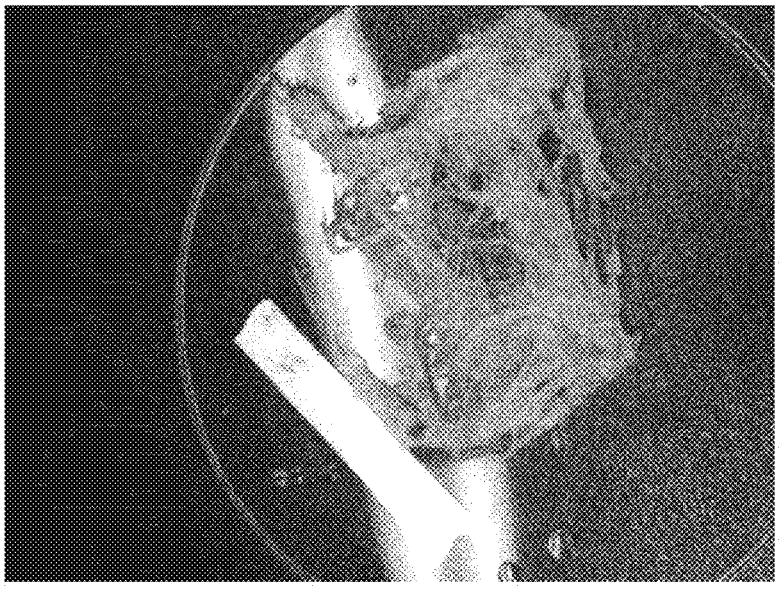
FIG. 5B is a photograph of an alkali retted plant fibre sample produced from mature *Brassica napus* plant material, according to embodiments of the present disclosure.
Figure 6A:
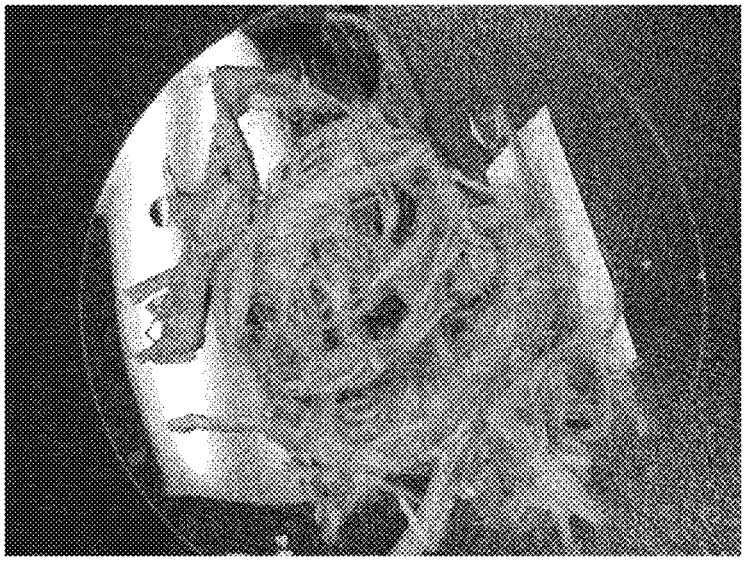
FIG. 6A is a photograph of an acid retted plant fibre sample produced from green *Brassica napus* plant material.
Figure 6B:
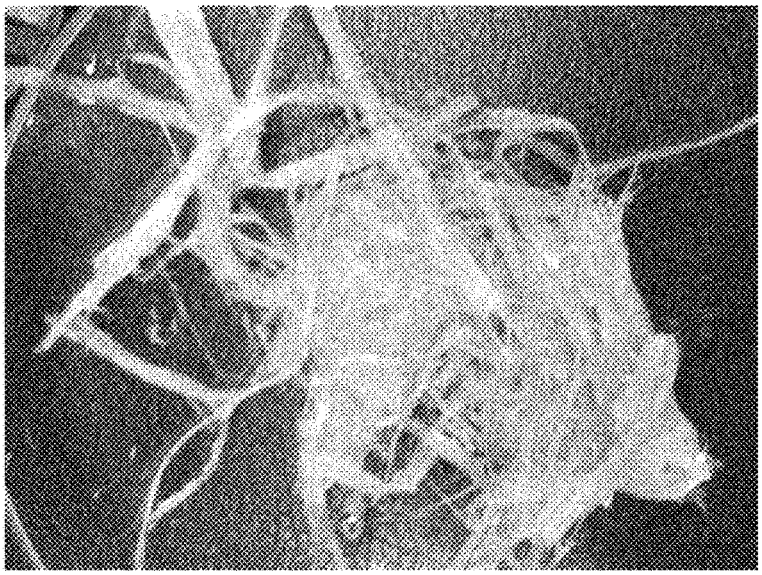
FIG. 6B is a photograph of an acid retted plant fibre sample produced from mature *Brassica napus* plant material, according to embodiments of the present disclosure.
Figure 7A:
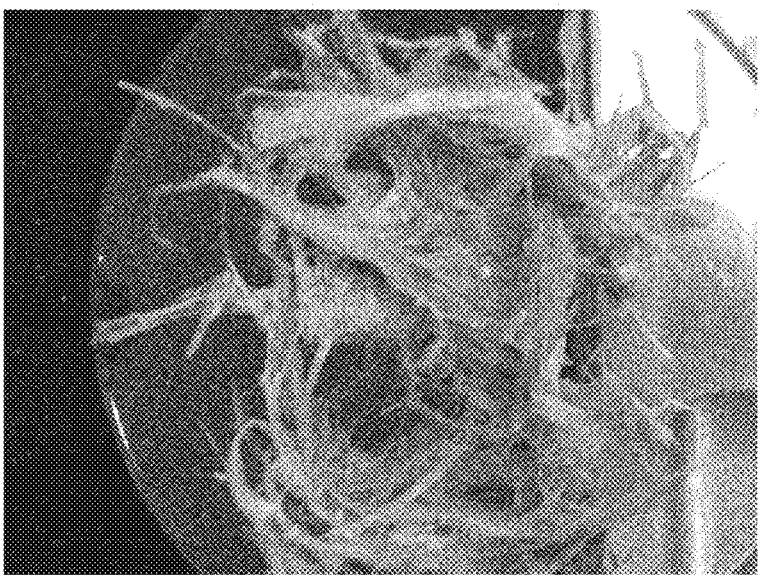
FIG. 7A is a photograph of an enzyme retted plant fibre sample produced from green *Brassica napus* plant material.
Figure 7B:
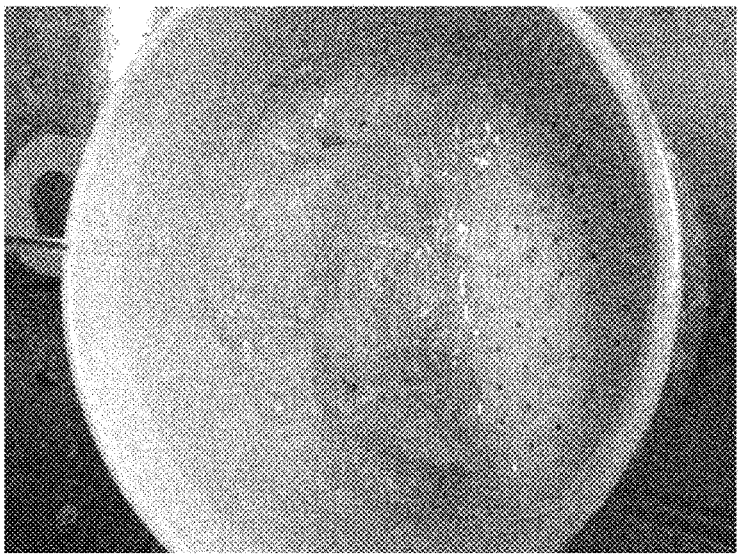
FIG. 7B is a photograph of an enzyme retted plant fibre sample produced from mature *Brassica napus* plant material, according to embodiments of the present disclosure.

Once the retting solution was prepared, 40 Mature cut samples were removed from the conditioning room, weighed and then vertically submerged into each of the solution beakers. To keep them submerged, an Erlenmeyer flask (1000 mL beakers) or a porcelain watch glass (600 mL beaker) was placed on top to keep the samples from sticking out. Similarly, Green samples were removed from the conditioning room, weighed and then vertically submerged into the remaining beakers (40 samples into the 1000 mL beaker and 26 samples into the 600 mL beaker) and held submerged in the same manner. Some solution was displaced and lost when samples were submerged. Some sample ends were not completely submerged and ends were allowed to remain out of solution. Submerged samples were stored in a dark cupboard at a relative humidity of 69% and observed periodically until samples were ready to ret (FIGS. 3A-3C). During the retting process, the samples were removed daily by removing the fibres from stalks to check the readiness of the samples. Retting techniques known in the art were tested and compared.

1.3.1 Water Retting 1000 mL of tap water was used for the water retting process. The water bath was prepared four times, one for each beaker, 2 containing Mature samples and 2 containing Green samples. The pH of tap water was 7.34. After 7 days submerged in water the fibre was sufficiently conditioned to be extracted.

1.3.2 Alkali Retting

Samples of plant material were treated by alkali retting in a similar manner as described above. A 0.1% NaOH alkali retting solution was prepared for each 600 mL beaker. The pH of the alkali retting solution was 12.30. Submerged samples were stored in the dark cupboard for 6 days at a relative humidity of 69%, after which time the fibre was sufficiently conditioned to be extracted.

1.3.3 Acid Retting

Acid retting was conducted in a 0.1% sulfuric acid retting solution prepared for each 600 mL beaker. The pH of the acid retting solution was 3.69. Submerged samples were stored in the dark cupboard for 5-6 days at a relative humidity of 69%, after which time the fibre was sufficiently conditioned to be extracted.

1.3.4 Enzyme Retting

Enzyme retting was conducted in a 0.1% pectinase enzyme retting solution prepared for each 1000 mL beaker. The pH of the enzyme retting solution was neutral. Submerged samples were stored in the dark cupboard for 6 days at a relative humidity of 69%, after which time the fibre was sufficiently conditioned to be extracted.

1.3.5 Retting Parameters

Further tests were carried out to observe the effects of retting parameters on retting efficiency of *Brassica* plant fibre.

TABLE 3

Effect of Retting Temperature and Water Change on Retting Time

| Retting temperature | Addition/change of water | Retting completion time (day) | Yield (%) |
|---|---|---|---|
| 20° C. | No | 8 | 11.57 |
| 20° C. | Daily (fresh water was added, old water was replaced) | 10 | 14.31 |
| 40° C. | No | 4 | 13.55 |
| *40° C. | Daily (fresh water was added, old water was replaced) | 22 | n/a |

**Brassica* variety, for example, Reston (*B. napus*)

Effect of Temperature on Retting

It can be seen from Table 3 that retting is much faster at 40° C. than at room temperature. At 40° C., the retting is completed in 4 days while at 20° C., the retting time was double (8 day).

Effect of Water Change on Retting

Further, changing the retting bath water daily with fresh water was found to increase the retting time by 20% at 20° C. and by more than fivefold at 40° C.

Effect of Material Liquor Ratio on Retting Time

The effect of material to liquor ratio on the retting time was also observed. It was found that material to liquor ratio has no effect on the completion of retting as retting completed in nine (9) days for both 1:10 and 1:100 material to liquor ratio (Table 4).

TABLE 4

Effect of Material to Liquor Ratio on Retting

| Retting temperature (° C.) | Material to liquor ratio | Addition/change of water | Retting completion time (day) |
|---|---|---|---|
| 40 | 1:10 | No | 9 |
| 40 | 1:100 | No | 9 |

Effect of Reuse Water on Retting Time

The effect of using distilled water and water from previously retted samples in retting *Brassica* plant material was observed. It was found that the retting completion time was much faster when retting water was reused. Specifically, retting was completed at 4 days with reused retting water compared to a retting completion time of 24 days with distilled water (Table 5).

TABLE 5

Effect of Reuse Water on Retting Time

| Retting temperature (° C.) | Type of retting water | Material to liquor ratio | Retting completion time (day) |
|---|---|---|---|
| 40 | Distilled water | 1:100 | 24 |
| 40 | Retting water | 1:100 | 4 |

1.4 Plant Fibre Production

When a sample was ready for fibre extraction, the beaker was removed from the cupboard and brought to the extraction station. The extraction station consists of a constant gentle stream of tap water running into a vacuum filter suspended in a sink. Solution was poured through the vacuum filter to catch any floating fibres. Stalks were removed individually from the retting bath. Any molded sections were cut off and placed in a separate beaker for a separate retting. Sample stalks were rinsed under the stream of tap water; the flow of the water gently peeled the fibres off the stalks. A gloved hand was also used to gently rub or peel off any fibres that remained. Once all the stalks from one solution were extracted, the fibres were removed from the vacuum filter and placed into a labelled watch glass to dry. The vacuum filter was then cleaned, removing any traces of the previous sample and then used again for the next sample. After extraction, the plant fibre samples were then transferred on to a watch glass (FIGS. 4-7), dried at room temperature for 24 hours and then transferred to standard conditioning atmosphere. Drying at room temperature before transferring to a conditioning room was necessary to avoid any hysteresis effect. The plant fibre samples were then weighed and yield was calculated (Table 6)

1.5 Plant Fibre Yield

TABLE 6

Plant Fibre yield (%) for different types of retting solution for both mature and green plants.

| Retting solution and plant type | | Weight of the conditioned sample before retting (g) | Weight of the conditioned plant after fibre extraction (g) | Weight (g) of the extracted fibres (conditioned) | Total weight of conditioned plant + fibre (g) | Plant Fibre Yield (%) |
|---|---|---|---|---|---|---|
| Water | Mature | 9.389 | 6.509 | 0.376 | 6.885 | 5.46 |
| | Green + green mold | 12.131 | 6.561 | 0.695 | 7.256 | 9.58 |
| 0.1% enzyme | Mature | 8.299 | 1.039 | 0.128 | 1.167 | 11.0 |
| | Green + green mold | 15.007 | 5.799 | 0.707 | 6.506 | 10.87 |
| 0.1% alkaline | Mature | 7.347 | 7.814 | 1.321 | 9.135 | 14.46 |
| | Green + green mold | 18.107 | 2.331 | 0.346 | 2.677 | 12.92 |
| 0.1% acid | Mature + mature mold | 9.365 | 5.105 | 0.614 | 5.719 | 10.74 |
| | Green + green mold | 18.107 | 10.516 | 1.642 | 12.158 | 13.51 |

Example 2: Dyeability

The ability of *Brassica* textile fibres to accept and retain a dye was investigated. The plant fibres were treated by a combination of scouring and bleaching before the dyeing process.

2.1 Scouring

Extracted plant fibre samples were treated for dyeability. The samples were first scoured before bleaching. A scouring solution included a mixture of tap water (100 mL), AATCC 1993 Standard Detergent (without Optic Brightener), without Phosphate (Test Fabrics, Inc.) (0.20 g), and Wet out solution (4-octylphenol polyethoxylate) (5 drops). 0.2 g of sample plant fibre was treated to give a material liquor ratio of 1:500.

Scouring was carried out in a Launder-ometer. Before the start of scouring, the scouring solution was preheated for 5 minutes at 60° C. After 60 minutes of scouring, the samples were removed and washed and neutralized. The samples were then transferred to a watch glass to dry.

Figure 8:
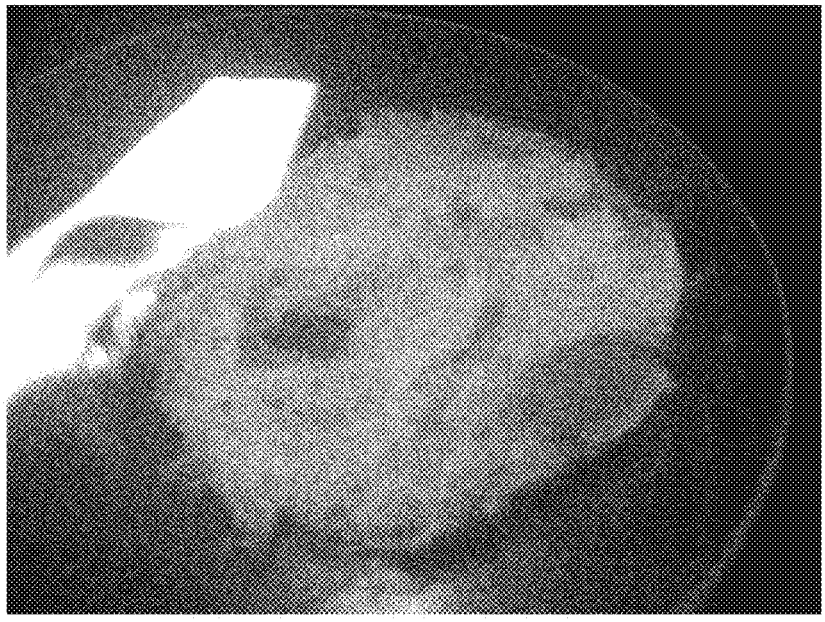
FIG. 8 is a photograph of a scoured plant fibre sample produced from mature *Brassica napus* plant material, according to embodiments of the present disclosure.

The scoured samples are shown in FIG. 8. The effect of scouring is provided in Table 7. It can be seen that due to scouring, plant fibre lost about 20% weight. The treated fibres become softer, thinner, translucent and easily separable.

TABLE 7

Effect of scouring

| Fibre retting media | Unsecured (conditioned) fibre weight (gram) | Scoured (conditioned) fibre weight (gram) | Weight loss (%) | Softness | Comments |
|---|---|---|---|---|---|
| Tap water | 0.20 | 0.159 | 20.5 | The scoured was much softer than the unsecured fibre | The scoured fibres: Look finer Translucent Easy to distinguish fibres Easy to separate fibres Fibres are softer |

2.2 Bleaching

Scoured samples were then treated to bleaching. For bleaching, plant fibre samples were treated in a Launder-ometer with bleaching solution for 120 minutes at 90° C. The bleaching solution used included a mixture of hydrogen peroxide (contains inhibitor, 30 wt. % in H2O, ACS reagent [Sigma-Aldrich]) (1 mL), NaOH (ACS reagent, ≥97.0%, pellets (Sigma-Aldrich)) (0.025%), Wet out solution (4-octylphenol polyethoxylate) (5 drops), at a material to liquor ratio of 1:1000.

After bleaching, plant fibre samples were rinsed using running tap water and transferred to a watch glass to dry.

Figure 9:
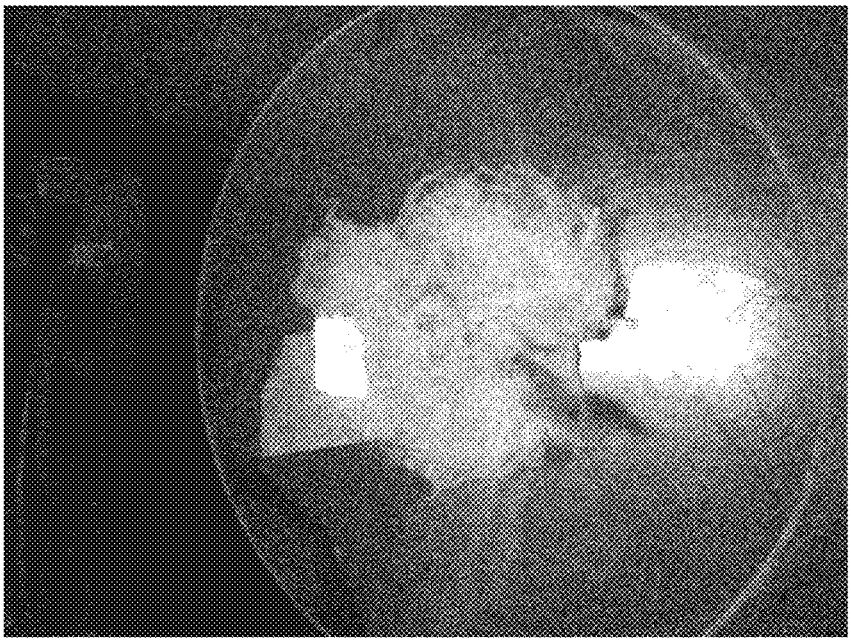
FIG. 9 is a photograph of a bleached plant fibre sample produced from mature *Brassica napus* plant material, according to embodiments of the present disclosure.

The effect of bleaching alone on plant fibre samples is shown in FIG. 9 and Table 8. After bleaching, the fibres were finer and whiter than the scoured samples. The treated plant fibre was softer than the original plant fibre samples but not as soft as the scoured samples.

TABLE 8

Effect of bleaching

| Fibre retting media | Unbleached (conditioned) fibre weight (gram) | Bleached (conditioned) fibre weight (gram) | Weight loss (%) | Softness | comments |
|---|---|---|---|---|---|
| Tap water | 0.159 | 0.118 | 25% | The bleached was much softer but not as much as scoured sample | The bleached fibres: Look finer than scoured fibre; Translucent; Easy to distinguish and cleaner fibres; Easy to separate fibres Fibres are softer; |

2.3 Dyeing

Scoured and bleached samples were then treated to the dyeing process. The dye solution was prepared by combining 0.1 gram of reactive dye to 100 mL water in two Launder-ometer containers, one for mature plant fibre and one for green plant fibre. 1.0 gram of NaCl was then dissolved in 2 mL of water; and 0.25 gram of sodium carbonate was separately dissolved in 1 mL of water.

The dyeing process was conducted in a Launder-ometer. Bleached plant fibre from mature and green *Brassica* were added to respective containers containing preheated water (50° C.) with the dye solution and cycled for 20 minutes (10 minutes to heat solution in container and 10 minutes of optimal dyeing). At the end of the cycle, the sodium chloride solution (1 gram in 2 mL of Tap Water) was added to each Launder-ometer container and cycled for 30 minutes after which sodium bicarbonate solution (0.25 gram in 1 mL of Tap Water) was added to each Launder-ometer container and cycled for another 20 minutes.

The fibres were then treated to an after treatment of a cold water rinse and cycling with a soap solution. The soap solution being a mixture of tap water (90 mL) combined with stock soap solution (10 mL, 1%). The plant fibre samples were then cycled in the Launder-ometer for 10 minutes with the soap solution, rinsed in cold water for 5 minutes, followed by a warm water rinse (60° C.) for 5 minutes then placed on labelled watch glass to dry.

Figure 10:
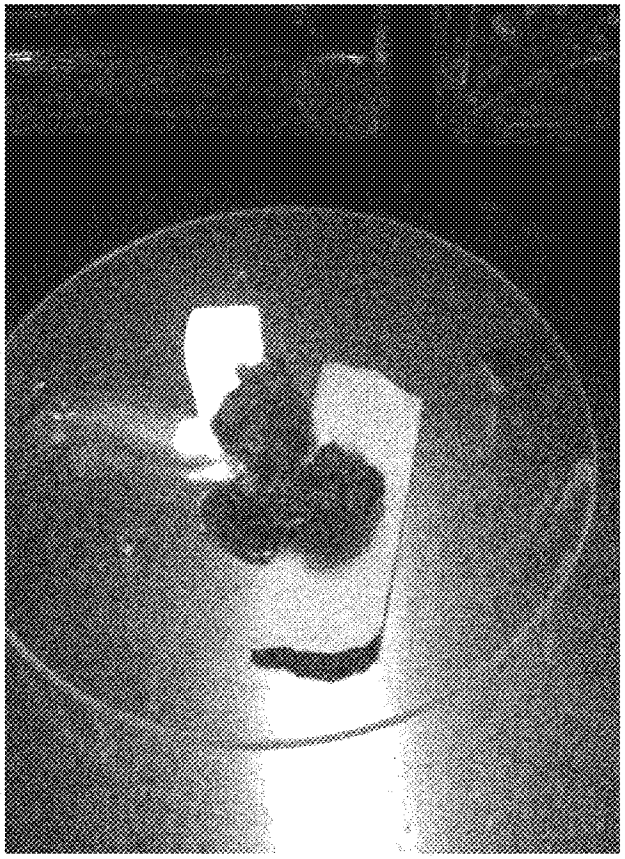
FIG. 10 is a photograph of a dyed plant fibre sample produced from mature *Brassica napus* plant material, according to embodiments of the present disclosure.
Figure 11A:
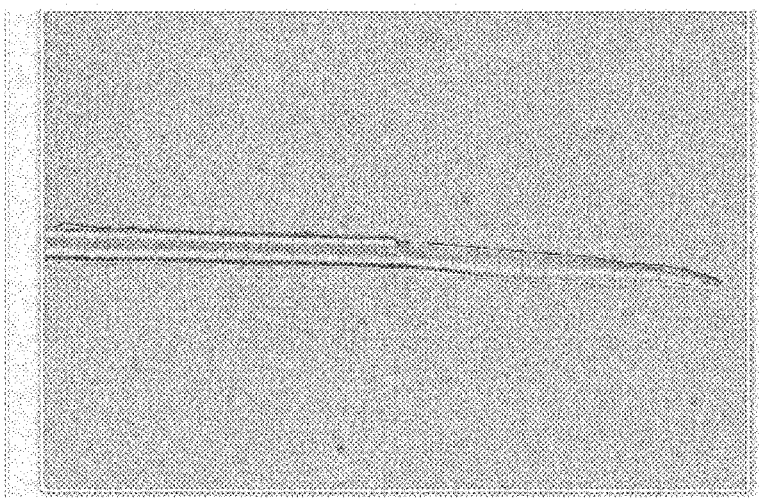
FIG. 11A is a photograph showing fibre diameter determination of a mature top (1) of a plant fibre sample.
Figure 11B:
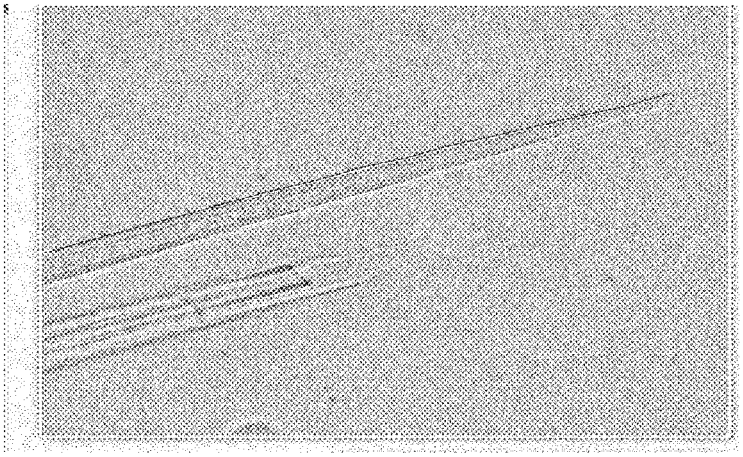
FIG. 11B is a photograph showing fibre diameter determination of mature bottom (1) of a plant fibre sample, according to embodiments of the present disclosure.
Figure 12A:
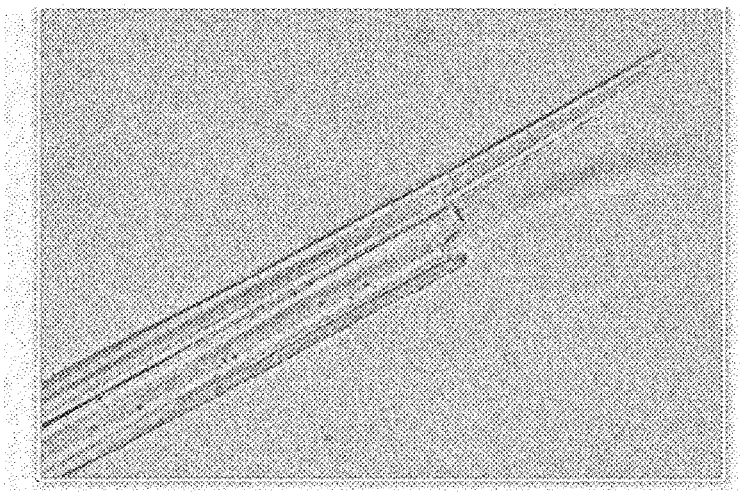
FIG. 12A is a photograph showing fibre diameter determination of a mature top (2) of a plant fibre sample.
Figure 12B:
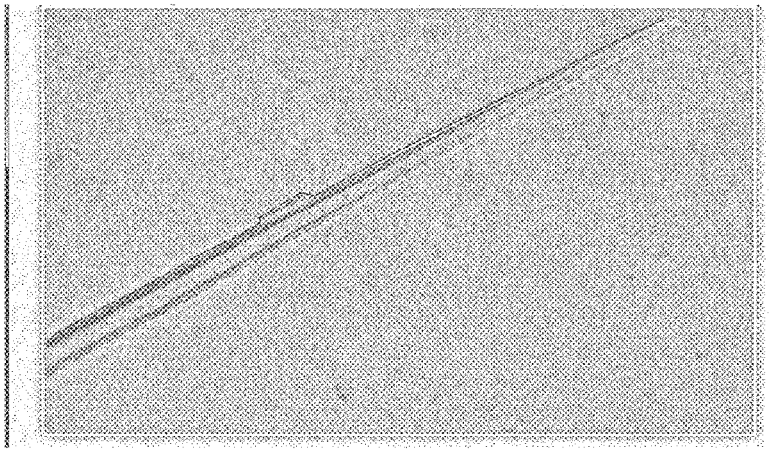
FIG. 12B is a photograph showing fibre diameter determination of mature bottom (2) of a plant fibre sample, according to embodiments of the present disclosure.
Figure 13A:
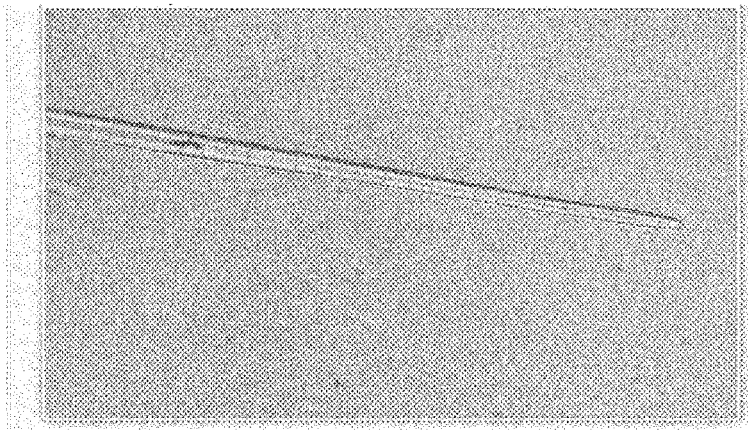
FIG. 13A is a photograph showing fibre diameter determination of a mature top (8) of a plant fibre sample.
Figure 13B:
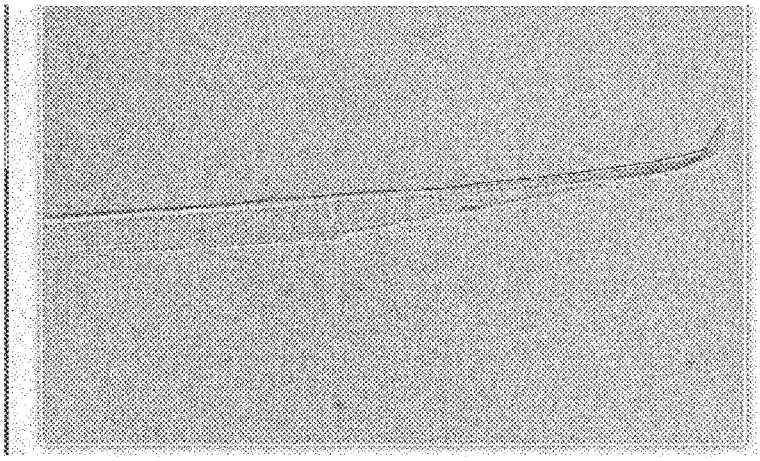
FIG. 13B is a photograph showing fibre diameter determination of mature bottom (8) of a plant fibre sample, according to embodiments of the present disclosure.
Figure 14A:
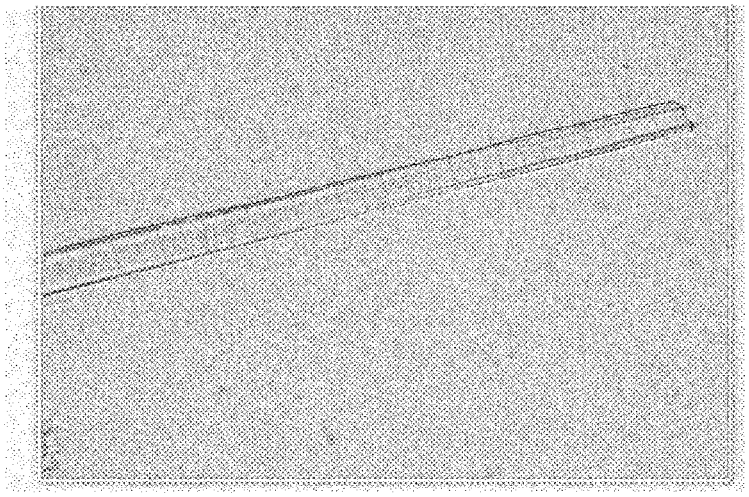
FIG. 14A is a photograph showing fibre diameter determination of a mature top (9) of a plant fibre sample.
Figure 14B:
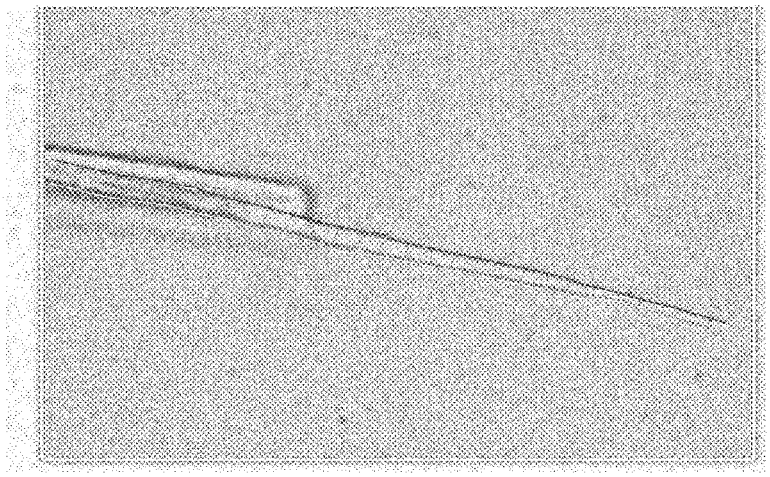
FIG. 14B is a photograph showing fibre diameter determination of mature bottom (9) of a plant fibre sample, according to embodiments of the present disclosure.
Figure 15A:
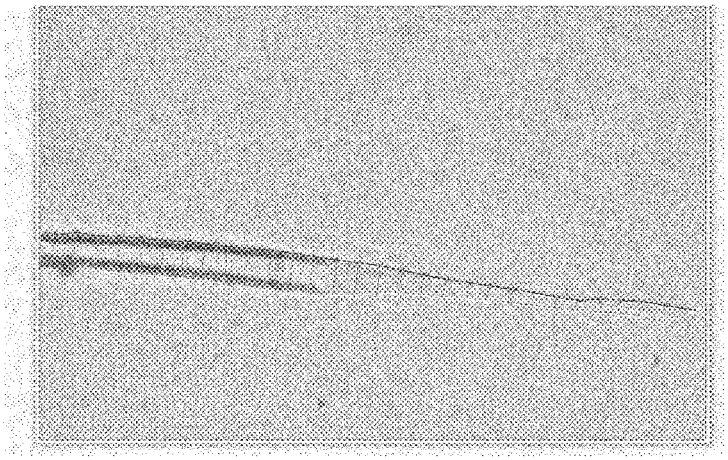
FIG. 15A is a photograph showing fibre diameter determination of a mature top (10) of a plant fibre sample.
Figure 15B:
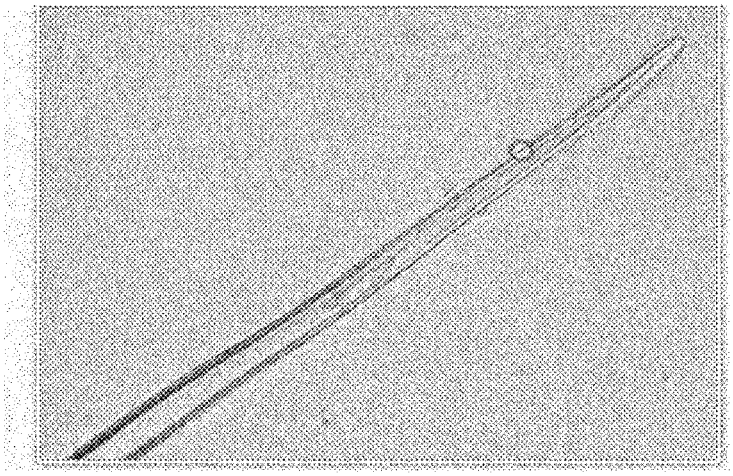
FIG. 15B is a photograph showing fibre diameter determination of mature bottom (10) of a plant fibre sample, according to embodiments of the present disclosure.
Figure 16:
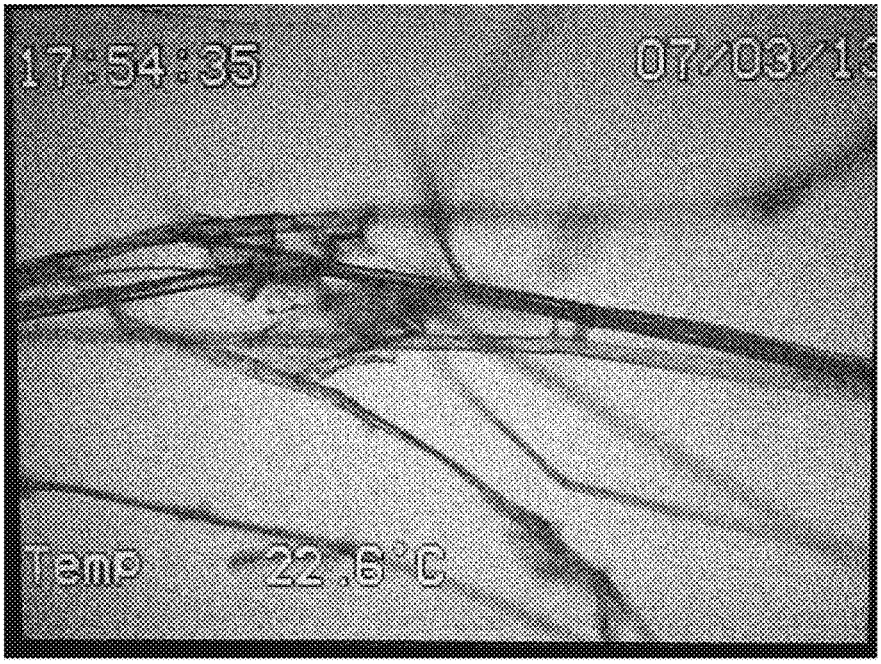
FIG. 16 is a photograph showing the appearance of a plant fibre sample at 22.6° C. after 10 minutes, according to embodiments of the present disclosure.
Figure 17:
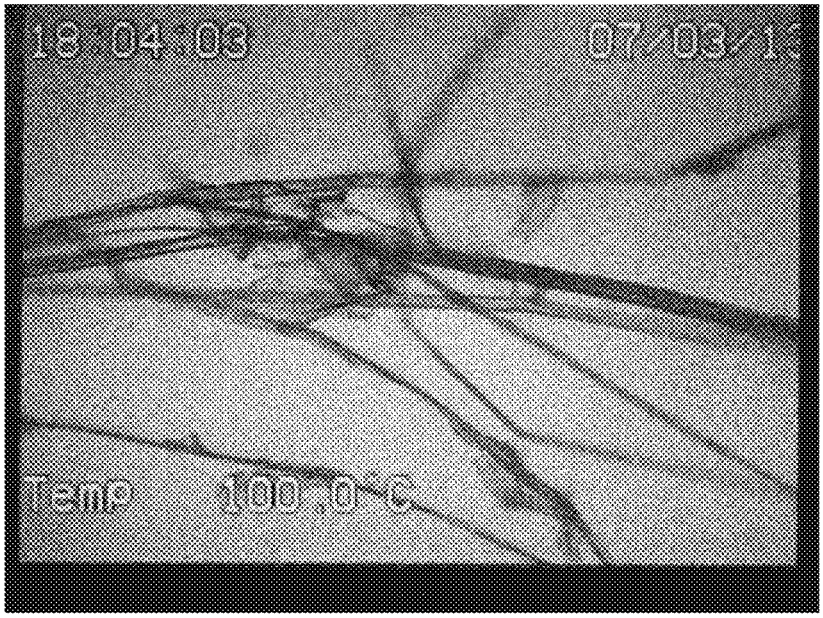
FIG. 17 is a photograph showing the appearance of a plant fibre sample at 100.0° C. after 10 minutes, according to embodiments of the present disclosure.
Figure 18:
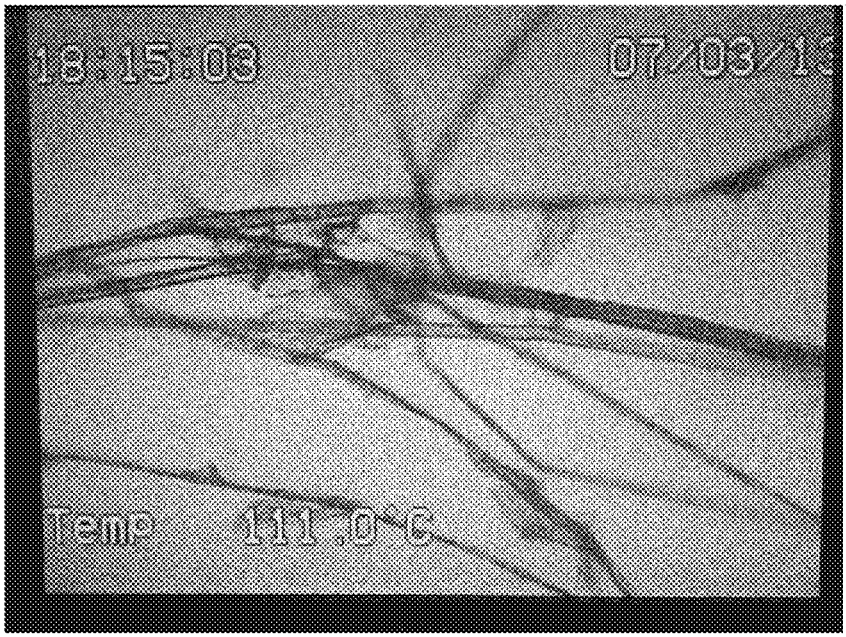
FIG. 18 is a photograph showing the appearance of a plant fibre sample at 111.0° C. after 10 minutes, according to embodiments of the present disclosure.
Figure 19:
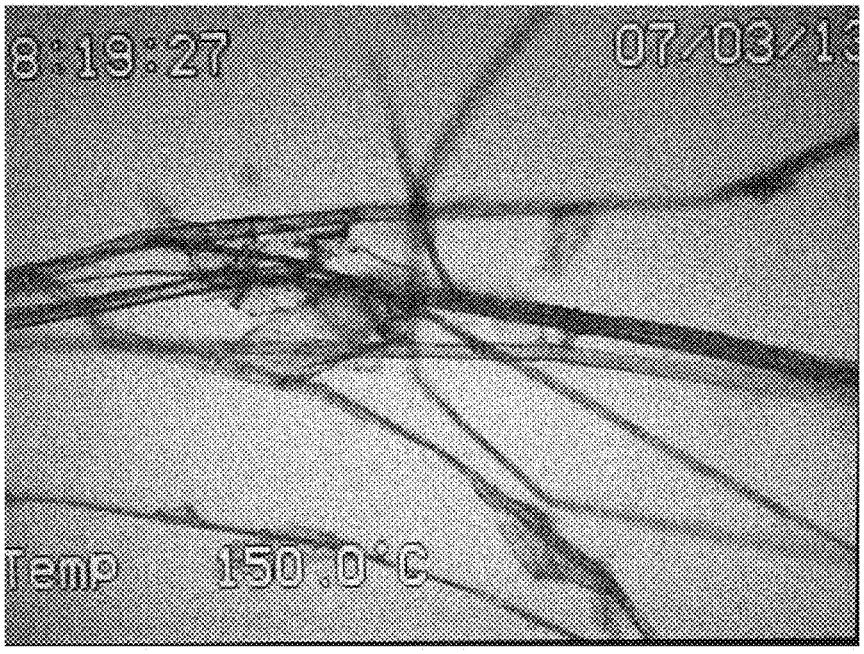
FIG. 19 is a photograph showing the appearance of a plant fibre sample at 150.0° C. after 10 minutes, according to embodiments of the present disclosure.
Figure 20:
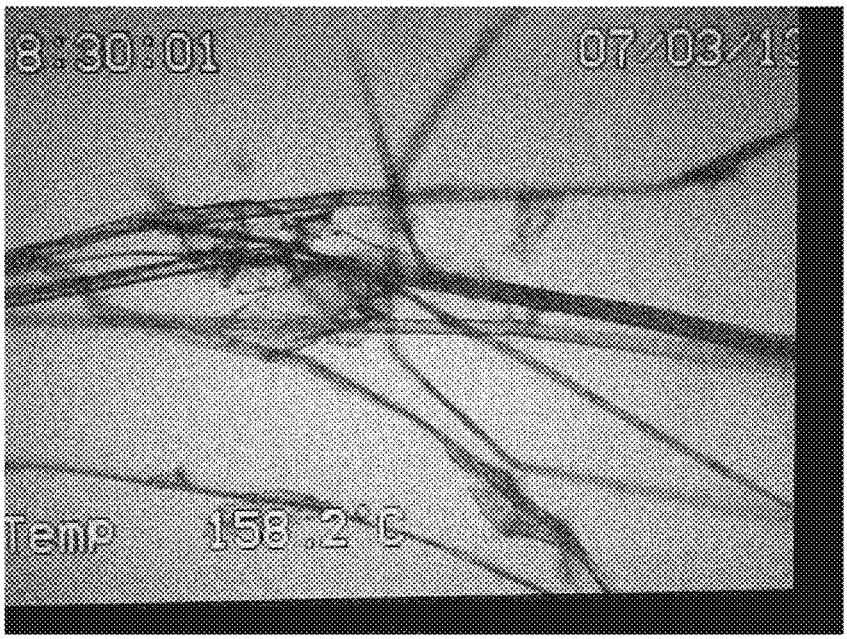
FIG. 20 is a photograph showing the appearance of a plant fibre sample at 158.2° C. after 10 minutes, according to embodiments of the present disclosure.
Figure 21:
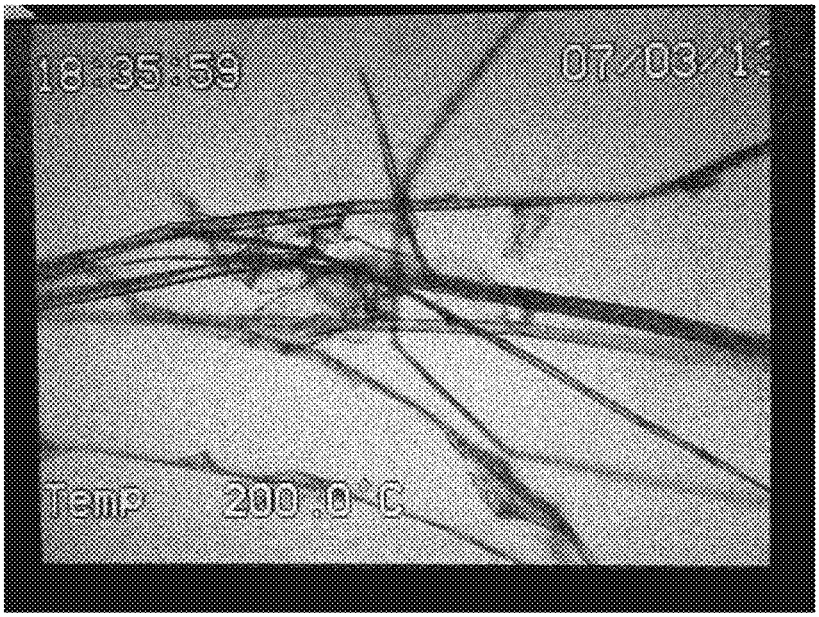
FIG. 21 is a photograph showing the appearance of a plant fibre sample at 200.0° C. after 10 minutes, according to embodiments of the present disclosure.
Figure 22:
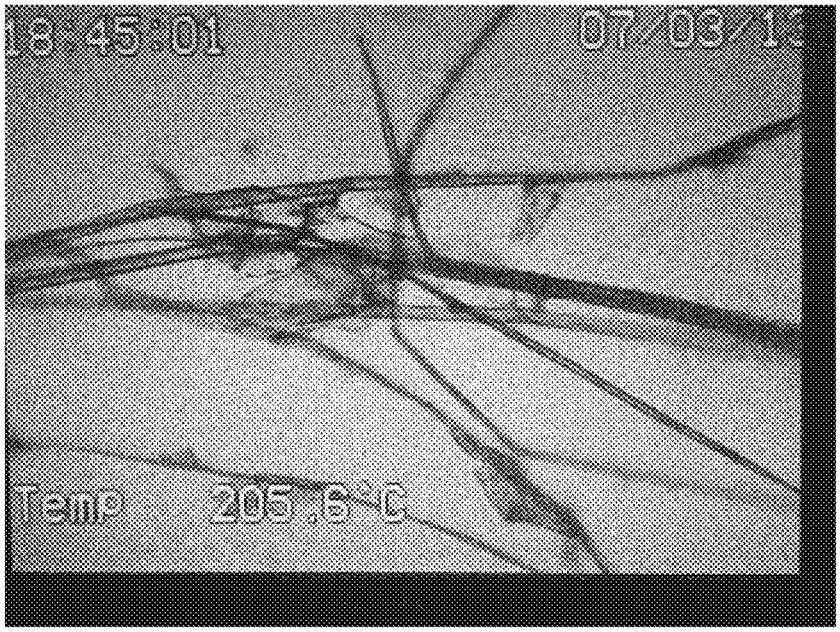
FIG. 22 is a photograph showing the appearance of a plant fibre sample at 205.6° C. after 10 minutes, according to embodiments of the present disclosure.
Figure 23:
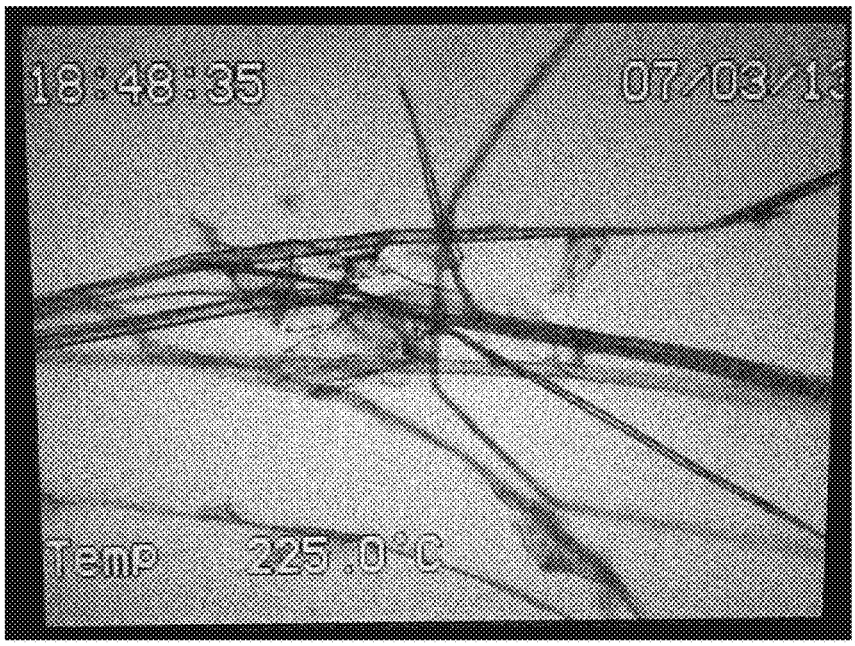
FIG. 23 is a photograph showing the appearance of a plant fibre sample at 225.0° C. after 10 minutes, according to embodiments of the present disclosure.
Figure 24:
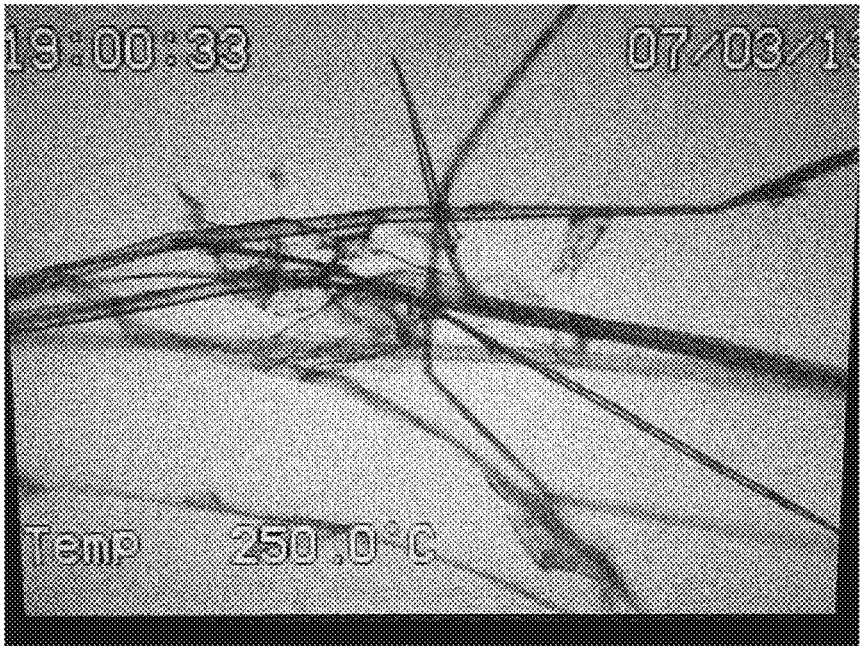
FIG. 24 is a photograph showing the appearance of a plant fibre sample at 250.0° C. after 10 minutes, according to embodiments of the present disclosure.
Figure 25:
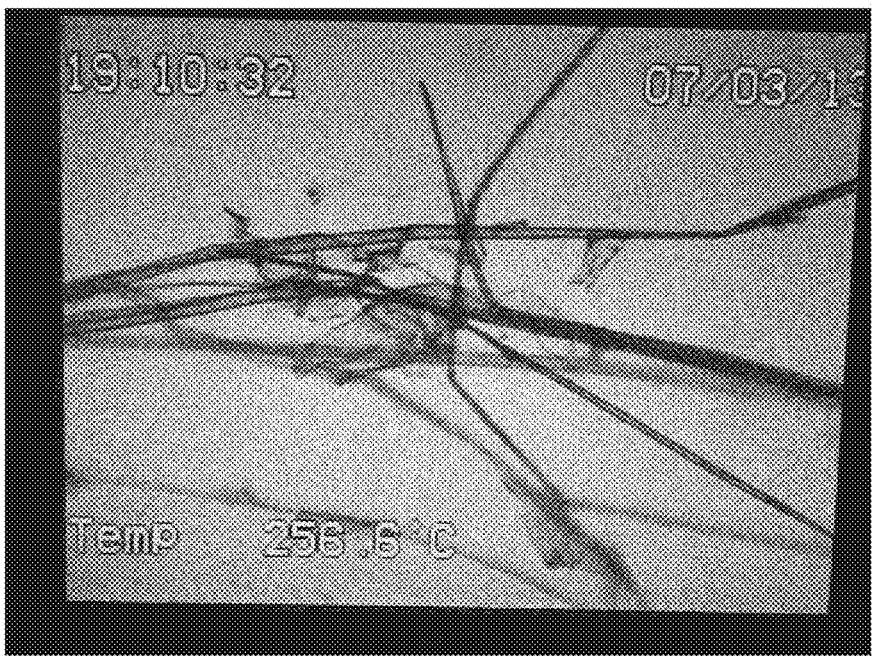
FIG. 25 is a photograph showing the appearance of a plant fibre sample at 256.6° C. after 10 minutes, according to embodiments of the present disclosure.
Figure 26:
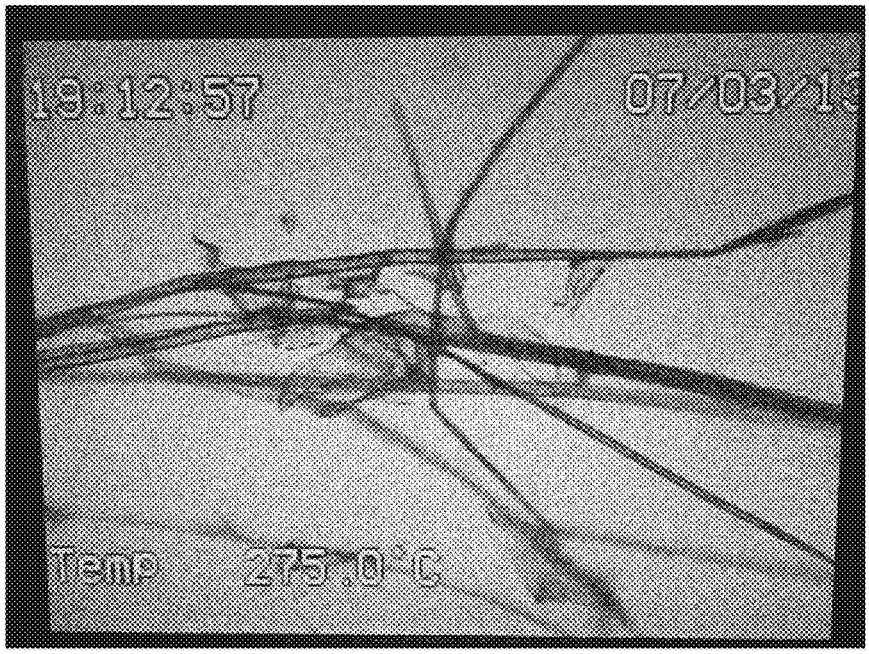
FIG. 26 is a photograph showing the appearance of a plant fibre sample at 275.0° C. after 10 minutes, according to embodiments of the present disclosure.
Figure 27:
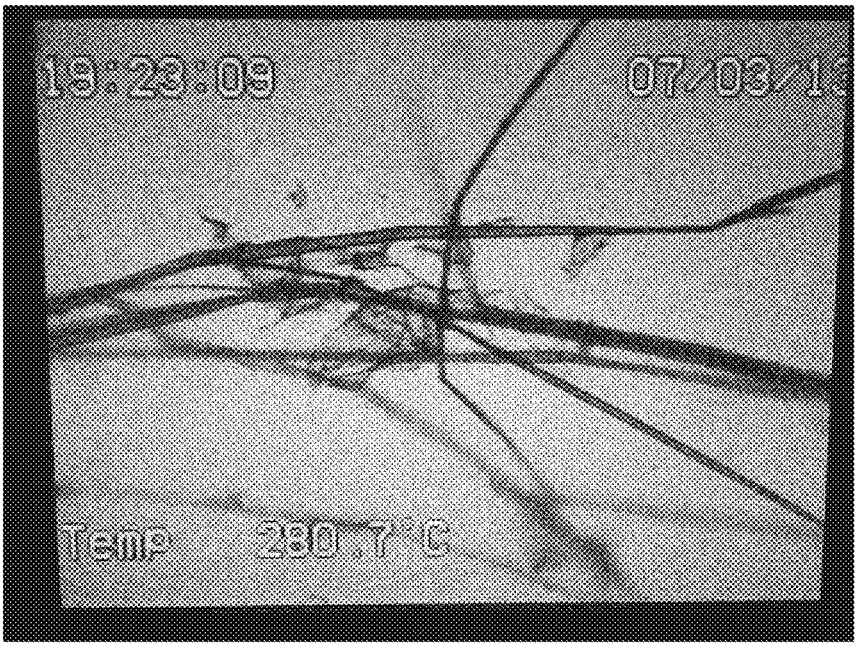
FIG. 27 is a photograph showing the appearance of a plant fibre sample at 280.7° C. after 10 minutes, according to embodiments of the present disclosure.
Figure 28:
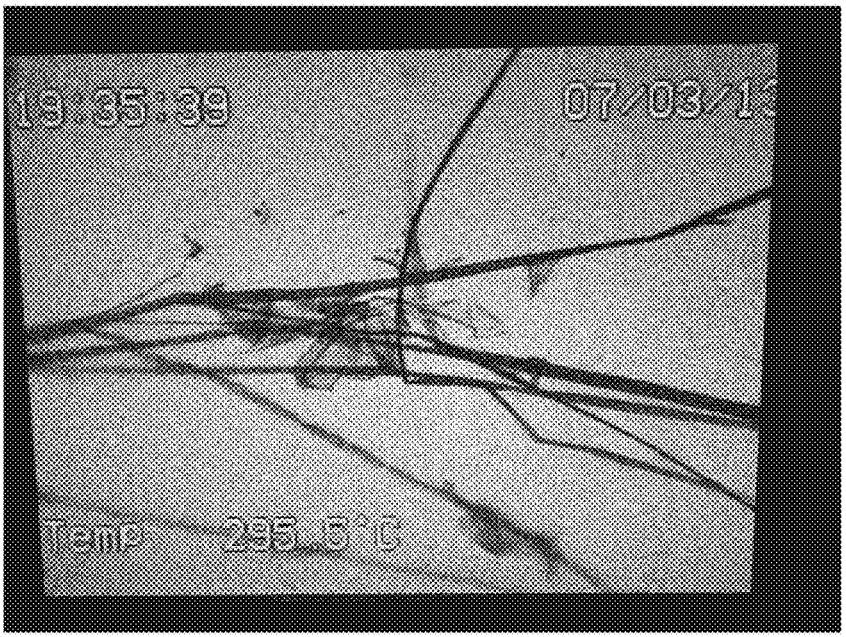
FIG. 28 is a photograph showing the appearance of a plant fibre sample at 295.5° C. after 10 minutes, according to embodiments of the present disclosure.
Figure 29:
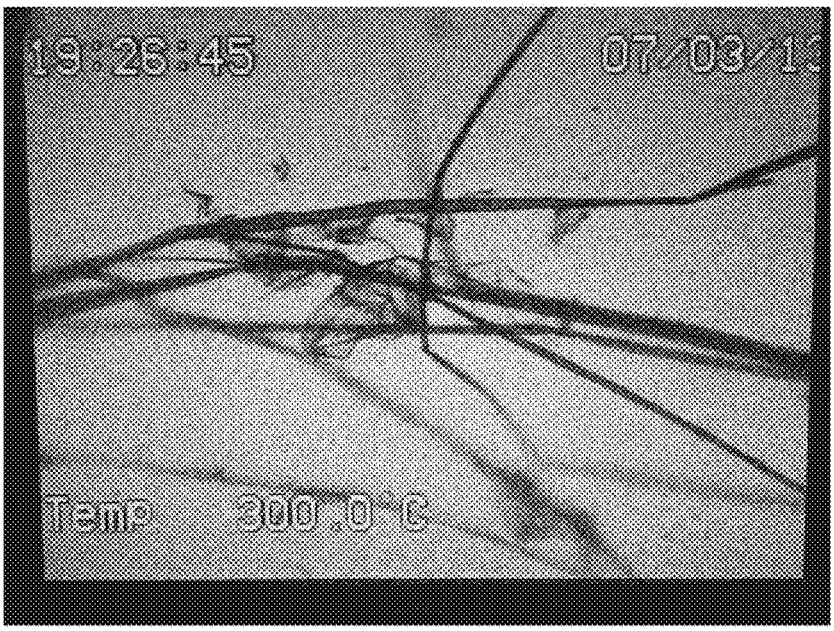
FIG. 29 is a photograph showing the appearance of a plant fibre sample at 300.0° C. after 10 minutes, according to embodiments of the present disclosure. At this stage the plant fibre is already exposed to stepped increase in temperature from 22.6° C.-295° C. for 120 minutes.

The dyed samples are shown FIG. 10. The treated plant fibre absorbed most of the dye (blue shade) as the remaining dye bath solution was a very light blue colour. It seems that dye penetrated inside the fibre, and probably formed chemical bonds because after washing with soap solution at 60° C., the difference in shade was not significant.

Example 3: Moisture Regain 3.1 Oven Drying Method

The moisture regain was calculated using the 'constant dried weight method' as described in ASTM D 2495-07 test method (American Standard Testing Materials (2008), Test method # ASTM D-2495-07. ASTM International, USA). The samples were conditioned in a standard conditioning atmosphere (at 21° C. and 65% Relative Humidity) for 6 days and weight was recorded. Then the drying oven was preheated to 105° C. Once the oven reached 105° C., all plant fibre samples were placed on the drying rack. After 60 minutes the samples were taken out and weighed to three decimal places. This weighing process was repeated every 30 minutes, 90 minutes, 120 minutes, 150 minutes and 180 minutes until a relatively constant sample weight+/−0.05 was achieved. After the final weighing, all samples were removed from their watch glass and placed into small, labelled sealable plastic bags. For moisture regain calculation, lowest weight was considered as 'Sample Weight Dried', using the following formula (Collier, J., and Epps, H. 1999. Textile Testing and Analysis. Upper Saddle River, N.J. Prentice Hall, p 65):

$$\text{Moisture regain (\%)} = \frac{\text{weight of the conditioned sample} - \text{weight of the dried sample}}{\text{weight of the dried sample}} \times 100$$

3.2 Determination of Moisture Regain (%)

The moisture regain values for canola plant fibre compared with other commercially available textile fibre are given in Table 9. It can be seen that the moisture regain for canola plant fibre lies between 20 to 30% which is much higher than the moisture regain of cotton and wool as well as other plant fibres (flax).

TABLE 9

Moisture regain data for all four retted fibres

| Sample type | Conditioned weight (g) | Dried weight (g) | Moisture regain (%) | Moisture regain of commercially available fibre |
|---|---|---|---|---|
| Water -mature | 0.376 | 0.290 | 29.66% | Cotton: 8-11%; |
| Alkali-mature | 0.614 | 0.491 | 25.05% | Polyester: 0.4%; |

TABLE 9-continued

Moisture regain data for all four retted fibres

| Sample type | Conditioned weight (g) | Dried weight (g) | Moisture regain (%) | Moisture regain of commercially available fibre |
|---|---|---|---|---|
| Acid -mature | 0.764 | 0.634 | 20.50% | Flax: 12%; |
| Enzyme - mature | 0.707 | 0.571 | 23.82% | Wool: 13-18%; |

Example 4: Plant Fibre Diameter 4.1 Determination of Diameter

To determine the fibre diameter a Bioquant Analyzer, which is connected with camera, computer and microscope is used (Bioquant Image Analysis Corporation. 2010. Bioquant life science system. Nashville Tenn., USA). A protocol has been developed and for each plant fibre sample, at least 10 measurements were taken along the length of the plant fibre. For diameter measurement, the individual plant fibre was first used for mechanical test measurement and then each broken section (top and bottom) was immediately used for microscope slide preparation.

4.2 Plant Fibre Diameter

Plant fibre diameter data for each fibre for both sections (top and bottom) is given in Table 10 and the positions of diameter measurement are given in FIGS. 11-15. This Table also contains the average diameter of each plant fibre and grand average of all plant fibre samples. It can be seen that the diameter of mature canola plant fibre is 15.3273 μm, which is similar to the diameter of cotton fibre (16-20 μm) (Kathryn, H. 2006. Textile Science. Revised ed. Apex NC: Tailored text custom publishing).

TABLE 10

Diameter data (μm)

| Measure # | Mature-1 top | Mature-1 bottom | Mature-2 top | Mature-2 bottom | Mature-3 top | Mature-3 bottom | Mature-4 top | Mature-4 bottom | Mature-5 top | Mature-5 bottom |
|---|---|---|---|---|---|---|---|---|---|---|
| 1 | 18.0261 | 16.6442 | 19.9913 | 17.4579 | | 31.4303 | 14.6833 | 25.4834 | 15.8410 | 8.7798 |
| 2 | 17.5595 | 16.6442 | 19.9913 | 17.4579 | | 30.4996 | 15.1679 | 25.7335 | 15.1679 | 8.9536 |
| 3 | 16.5871 | 16.6442 | 19.6321 | 17.4579 | | 29.2208 | 14.8997 | 25.7335 | 14.8439 | 8.3789 |
| 4 | 16.5656 | 16.6442 | 19.6321 | 17.8807 | | 30.1201 | 15.1679 | 26.1585 | 14.5290 | 8.3789 |
| 5 | 15.5920 | 16.1891 | 19.3890 | 17.4579 | | 31.0621 | 14.4225 | 26.1585 | 13.7748 | 7.9876 |
| 6 | 15.5920 | 15.7359 | 18.3779 | 17.8807 | | 31.0621 | 14.6833 | 26.1585 | 14.2238 | 8.6161 |
| 7 | 15.1288 | 14.8359 | 17.2185 | 17.9602 | | 31.8016 | 14.6833 | 26.1585 | 13.5404 | 9.6669 |
| 8 | 16.0788 | 14.3896 | 17.1564 | 17.4579 | | 33.1240 | 13.9459 | 26.1585 | 12.8575 | 8.6710 |
| 9 | 15.5920 | 14.8359 | 16.5656 | 16.2110 | | 33.7553 | 13.9459 | 25.7335 | 12.8575 | 8.3789 |
| 10 | 15.5920 | 14.8359 | 16.3712 | 15.9529 | | 33.3168 | 12.7463 | 25.6642 | 12.3973 | 8.9536 |
| 11 | 15.1053 | 14.3235 | 15.9529 | 16.3639 | | 33.7026 | 12.0480 | 25.2590 | 12.3973 | 8.3789 |
| 12 | 15.1053 | 13.8606 | 16.3639 | 18.7990 | | 34.4818 | 11.2962 | 24.8901 | 12.1753 | 9.6054 |
| 13 | 16.6185 | 13.8606 | 16.3639 | 19.1923 | | 35.9203 | 11.2962 | 24.8568 | 12.0579 | 9.1889 |
| 14 | 14.6185 | 13.8606 | 16.3712 | 16.3712 | | 34.3025 | 10.6365 | 24.8568 | 12.3973 | 8.7798 |
| 15 | 15.2925 | 13.3995 | 15.9529 | 15.1288 | | 32.5535 | 10.1691 | 24.0567 | 12.0579 | 8.3789 |
| 16 | 13.3711 | 12.4831 | 15.5387 | 15.5387 | | 30.8822 | 9.8492 | 24.4576 | 12.1753 | 7.6230 |
| 17 | 13.1854 | 12.0283 | 14.8119 | 15.1288 | | 29.0008 | 9.2404 | 24.4576 | 12.1753 | 7.9876 |
| 18 | 14.1569 | 12.0283 | 14.3813 | 15.1288 | | 29.2208 | 8.3221 | 24.8568 | 11.7288 | 7.1907 |
| 19 | 14.1569 | 11.5762 | 13.9544 | 14.3235 | | 29.6118 | 8.3221 | 24.8568 | 11.4111 | 6.7658 |
| 20 | 14.1569 | 11.1269 | 13.9289 | 13.6451 | | 29.6118 | 8.4071 | 24.4576 | 11.1056 | 6.2368 |
| 21 | 13.6711 | 9.7037 | 13.9544 | 13.6451 | | 30.0057 | 24.0567 | 24.4576 | 11.1056 | 5.5528 |
| 22 | 13.6711 | 9.2404 | 13.9289 | 13.6451 | | 29.2208 | | 25.6642 | 11.1056 | 5.2453 |
| 23 | 13.1854 | 8.3221 | 14.3235 | 12.8575 | | 29.3706 | | 26.8962 | 11.4111 | 4.4900 |
| 24 | 12.2142 | 7.4180 | 14.3235 | 12.8575 | | 29.0008 | | 27.6913 | 11.0413 | 4.3560 |
| 25 | 10.7585 | 6.5340 | 13.9289 | 12.0972 | | 30.0570 | | 28.9107 | 10.6810 | 3.7090 |
| 26 | 9.3044 | 5.6795 | 13.5404 | 11.2119 | | 32.8039 | | 29.3261 | 10.6810 | 3.7090 |
| 27 | 8.3363 | 6.1023 | 13.1584 | 11.2119 | | 31.4906 | | 29.7357 | 10.8134 | 4.1324 |
| 28 | 8.3363 | 6.1023 | 12.2917 | 10.8134 | | 30.8399 | | 29.3221 | 10.6810 | 5.0141 |

TABLE 10-continued

| Diameter data (μm) | | | | | | | | | | |
|---|---|---|---|---|---|---|---|---|---|---|
| 29 | 6.3312 | | 12.2917 | 9.3552 | | 33.1741 | | 28.0952 | 10.6810 | 3.2670 |
| 30 | | | 12.2917 | 8.6161 | | 23.0188 | | 28.5017 | | |
| 31 | | | 11.8895 | 6.9216 | | | | 29.8154 | | |
| 32 | | | 11.8895 | | | | | | | |
| Average | 13.879 | 12.323 | 15.492 | 14.711 | | 31.124 | 12.197 | 26.207 | 12.342 | 7.116 |
| Measure # | Mature-6 top | Mature-6 bottom | Mature-7 top | Mature-7 bottom | Mature-8 top | Mature-8 bottom | Mature-9 top | Mature-9 bottom | Mature-10 top | Mature-10 bottom |
| 1 | 18.9685 | 16.4795 | 10.8899 | 22.0020 | 14.4225 | 22.9103 | 21.4120 | 12.0283 | 18.5129 | 21.1444 |
| 2 | 18.5449 | 16.1304 | 10.8899 | 22.0020 | 13.9459 | 22.4238 | 21.5004 | 12.0283 | 22.9103 | 20.6679 |
| 3 | 18.9685 | 16.8847 | 11.2436 | 22.1792 | 14.3235 | 22.5345 | 21.8777 | 12.5211 | 18.9997 | 19.8723 |
| 4 | 19.0185 | 15.8036 | 10.3196 | 22.0020 | 13.9459 | 22.4238 | 21.4120 | 12.0480 | 19.4866 | 19.8782 |
| 5 | 17.7075 | 15.8036 | 9.8613 | 19.9735 | 14.3235 | 22.9103 | 20.9472 | 11.5762 | 20.4603 | 19.0496 |
| 6 | 17.2941 | 15.5387 | 9.9332 | 20.0623 | 13.4701 | 22.4238 | 20.9472 | 11.5762 | 19.4866 | 18.3068 |
| 7 | 18.1245 | 15.6830 | 10.4111 | 20.0623 | 12.9951 | 22.5345 | 20.5529 | 12.0283 | 20.0623 | 17.8807 |
| 8 | 15.9529 | 15.6831 | 10.4111 | 19.7766 | 12.9951 | 22.7389 | 20.0801 | 10.6810 | 19.2970 | 17.8343 |
| 9 | 16.7931 | 15.2925 | 9.9332 | 19.7766 | 12.9951 | 23.5031 | 19.1366 | 11.1269 | 19.5352 | 17.4375 |
| 10 | 17.5595 | 15.2848 | 10.7805 | 19.5777 | 12.0480 | 23.9876 | 19.1366 | 11.1269 | 20.7367 | 17.0455 |
| 11 | 17.5595 | 15.6831 | 10.4111 | 19.0931 | 11.7793 | 23.8835 | 19.0994 | 10.2389 | 22.0020 | 17.4375 |
| 12 | 16.7578 | 15.2925 | 9.9332 | 20.7367 | 11.7793 | 23.8835 | 19.0994 | 10.1691 | 22.0020 | 17.0455 |
| 13 | 15.6831 | 15.6830 | 9.4058 | 20.7367 | 11.2962 | 23.8835 | 18.6660 | 12.0283 | 21.2172 | 16.8777 |
| 14 | 15.8036 | 15.5387 | 9.2661 | 19.2970 | 10.8134 | 20.5067 | 18.1963 | 12.0480 | 19.0931 | 16.6228 |
| 15 | 15.9008 | 15.1288 | 9.4561 | 20.5471 | 10.6365 | 19.0496 | 17.7275 | 11.1269 | 17.6404 | 15.5311 |
| 16 | 15.4007 | 15.5387 | 9.2667 | 19.5777 | 10.8134 | 17.1080 | 17.2598 | 9.2404 | 15.7057 | 14.6104 |
| 17 | 15.1699 | 15.9529 | 8.7798 | 20.0623 | 9.8492 | 15.1679 | 17.3830 | 8.8872 | 12.8113 | 13.8435 |
| 18 | 15.7057 | 16.3639 | 8.9801 | 20.2565 | 9.3679 | 13.9459 | 17.2598 | 8.7798 | 11.3694 | 13.3729 |
| 19 | 14.5290 | 17.1564 | 9.2661 | 20.2565 | 9.2404 | 13.9459 | 16.9057 | 8.7798 | 9.9332 | 13.3729 |
| 20 | 14.4553 | 17.5595 | 8.5053 | 20.2565 | 9.2404 | 12.2627 | 17.7275 | 8.3221 | 8.7798 | 12.3973 |
| 21 | 14.8679 | 16.7578 | 8.7798 | 20.5471 | 9.2404 | 12.5211 | 17.7275 | 8.3221 | 8.5053 | 12.4451 |
| 22 | 14.5290 | 16.7931 | 8.9801 | 18.8179 | 8.7798 | 12.2627 | 17.7275 | 7.9280 | 7.8074 | 11.6171 |
| 23 | 13.6451 | 17.1564 | 8.9536 | 19.5777 | 8.3221 | 11.5762 | 17.3830 | 7.4180 | 7.3214 | 10.8134 |
| 24 | 12.8575 | 16.7931 | 8.2935 | 20.7367 | 7.9280 | 10.8134 | 17.2598 | 5.0846 | 6.3499 | 10.3540 |
| 25 | 12.8667 | 17.1564 | 8.5053 | 21.0320 | 9.2404 | 9.8492 | 17.2598 | 4.3831 | 5.7003 | 10.0282 |
| 26 | | 16.1230 | 8.2935 | 20.7367 | 9.3679 | 9.8492 | 16.9057 | 3.7090 | 7.8528 | 9.6054 |
| 27 | | 9.1501 | 8.5053 | 17.1564 | 7.4499 | 8.3221 | 16.3277 | 4.1610 | 8.0320 | 8.6161 |
| 28 | | 7.2400 | 8.9536 | 8.5053 | | 6.4979 | 15.9529 | 4.1610 | 8.0320 | 7.3052 |
| 29 | | 5.4450 | 8.9801 | | | 2.8397 | | 3.8961 | 7.0910 | 4.8701 |
| 30 | | | | | | 4.4900 | | | | |
| Average | 16.199 | 15.210 | 9.524 | 19.834 | 11.134 | 16.702 | 18.674 | 9.1526 | 14.715 | 14.685 |
| Grand average | | | | | 15.3273 Cotton: 16-20 μm | | | | | |

Example 5: Heat Resistance 5.1 Determination of Thermal Properties (Decomposition Temperature):

Decomposition temperature was measured using the LINKAM Imaging Station which is connected with LINKAM Microscope, Olympus TH4-100, monitor and a system controller. The system controller is used to set up the temperature profile. A small amount of conditioned plant fibre was prepared on a slide which was covered with a glass cover. During thermal decomposition measurement, the microscopic slide was placed and aligned on the temperature control stage of the microscope in such a way that the sample is focused on the monitor and can be easily viewed. The rate of temperature was 10° C./minute and holding time was 10 minute. During running the profile any changes to the sample were recorded. When the profile was finished, the stage was opened and the slide allowed to cool. When cooled, sample was labelled and stored.

5.2 Decomposition Temperature (Mature Sample)

The decomposition temperature is shown in Table 11 and the appearance of plant fibre at different temperatures is given in FIGS. 16-29. It seems that heating 10 minutes at 250° C. did not change the plant fibre and plant fibres remain structurally unchanged. However, at 280° C., the fibres started to decompose and between 295-300° C. the plant fibre decomposed completely.

TABLE 11

| Decomposition temperature | | | | | |
|---|---|---|---|---|---|
| Ramps | Rate (° C./min) | Limit (° C.) | Hold Time (min) | FIG. # | Decomposition temperature of commonly used textile fibre* |
| 1 | 10° C./min | 22.6° C. | 10:00 min | 16 | Cotton: |
| 2 | 10° C./min | 100° C. | 10:00 min | 17 | 180° C.; |
| 3 | 10° C./min | 111° C. | 10:00 min | 18 | Wool: 135° C.; |
| 4 | 10° C./min | 150° C. | 10:00 min | 19 | Silk: 150° C.; |
| 5 | 10° C./min | 158.2° C. | 10:00 min | 20 | Polyester: |
| 6 | 10° C./min | 200° C. | 10:00 min | 21 | 260° C. |
| 7 | 10° C./min | 205° C. | 10:00 min | 22 | (melting temp.) |
| 8 | 10° C./min | 225° C. | 10:00 min | 23 | |
| 9 | 10° C./min | 250° C. | 10:00 min | 24 | |
| 10 | 10° C./min | 256.6° C. | 10:00 min | 25 | |
| 11 | 10° C./min | 275° C. | 10:00 min | 26 | |
| 12 | 10° C./min | 280° C. | 10:00 min | 27 | |
| 13 | 10° C./min | 295° C. | 10:00 min | 58 | |
| 14 | 10° C./min | 300° C. | 10:00 min | 29 | |

*Adanur, S (1995). Fiber Properties and Technology (Chapter 17). In Wellington Sears Handbook of Industrial Textiles, Technomic Publishing Co. Inc., pp555-607

Example 6: Burning Behaviour 6.1 Determination of Burning Behaviour:

To determine the burning behaviour, a plant fibre cluster is held using tweezers and the plant fibre advanced slowly toward the flame of a candle. The reaction of plant fibre as the flame is approached, plant fibre reaction while in the flame and its reaction following removal from the flame was recorded.

6.2 Burning Behaviour

The burning behaviour of plant fibre approaching the flame, while in the flame and after removal from the flame as well as residue is given in Table 12. This Table also contains the residue and burning behaviour of cotton fibre as a comparison.

TABLE 12

Burning behaviour

| Fibre type | Approaching the flame | In flame | Removing from flame | Residue |
|---|---|---|---|---|
| Mature - water | Fuses; Shrinks: Backs away from flame; | Burns rapidly; Puffs of smoke on extinguish; Grey/white smoke | Continuous burning; burns entirely; | Soft grey ash; |
| Cotton* | Fuses: no Shrinks: no | Burns rapidly; | Continues to burn with afterglow; | Grey, soft feathery ash; |

*Fibre Analysis: Qualitative. AATCC Test Method No. 20-2007. Technical Manual of the American Association of Textile Chemists and Colorists, 2010, 85, pp40-58

Example 7: Chemical Properties and Solubility 7.1 Chemical Properties and Solubility Test:

Solubility test was conducted according to the test method ASTM D 276-96 (ASTM D-276-00a: Standard Test Methods for Identification of Fibres in Textiles, Annual Book of ASTM Standards, 2008, v 7.01, pp 92-106). The plant fibre was treated in different chemicals for a specific time and temperature, and then the behaviour of plant fibre was noted.

7.2 Chemical Property and Solubility Test

The chemical property and solubility of the plant fibre are given in Table 13. It can be seen that the plant fibre is soluble in 70% sulphuric acid and cotton is also soluble in 70% sulphuric acid under similar conditions (Fibre Analysis: Qualitative. AATCC Test Method No. 20-2007. Technical Manual of the American Association of Textile Chemists and Colorists, 2010, 85, pp 40-58).

TABLE 13

Solubility test

| Chemical name | Concentration | Time (minute) | Temperature (° C.) | Observation | Results |
|---|---|---|---|---|---|
| Acetone | 100% | 2 | 20 | No change to the fibre | Insoluble |
| NaOH | 5% | 2 | 100 | Solution became cloudy as small precipitate formed; No change to the fibre | Insoluble |
| Formic Acid | ≤95% | 2 | 20 | Fibre sample lost all colouring but did not dissolve | Insoluble |
| Dimethyl formaldehyde | 100% | 2 | 70 | No change to the fibre | Insoluble |
| m-Cresol | 100% | 2 | 100 | No change to the fibre | Insoluble |
| $H_2SO_4$ | 70% | 2 | 20 | Some fibres dissolved in solution | Soluble |

Example 8: Mechanical Properties 8.1 Mechanical Property Test:

The mechanical properties were measured using an Instron Universal Tester Model 5965. The load cell was 500 N, the gauge length was 25 mm and the speed of the machine was 50 mm/min.

Before testing, mature plant fibre samples were conditioned for at least 48 hours. A single plant fibre was (individual) extracted from the plant fibre bundle and the plant fibre was mounted in the grip (jaws) with equal length of ends in each grip. The test was then run. After the completion of the test, the plant fibre halves were placed on a labelled slide with the top grip plant fibre half on top and the bottom grip plant fibre half on the bottom of the slide with broken ends both facing the same direction. This was necessary to calculate the tenacity of the plant fibre using diameter data. Ten plant fibre samples were used for this test.

8.2 Mechanical Property Test:

The mechanical properties such as maximum load, load at break and tenacity data are given in Table 14. The tenacity value was calculated from the diameter value (15.3273) given in Table 10. For comparison, the tenacity of cotton is also provided in this Table.

TABLE 14

| Mechanical properties | | | | | |
|---|---|---|---|---|---|
| Observation # | Maximum load (N) | Load at break (N) | Linear density (tex) | Tenacity at maximum load (g/d) | Tenacity at break (g/d) |
| 1 | 0.03483 | 0.00436 | 0.26 | 10.346 | 0.322 |
| 2 | 0.27423 | 0.00684 | (calculated | (cotton: | |
| 3 | 0.28225 | 0.00177 | using 15.3273 | 3.0-4.5) | |
| 4 | 0.24486 | 0.01476 | μm and | | |
| 5 | 0.11849 | 0.00610 | density | | |
| 6 | 0.18847 | 0.00964 | (p) of 1.5 g/cc | | |
| 7 | 0.11781 | 0.00954 | | | |
| 8 | 0.33671 | 0.00476 | | | |
| 9 | 0.69805 | 0.00874 | | | |
| 10 | 0.07850 | 0.00742 | | | |
| Average and SD | 0.23742 ± 0.18933 | 0.00739 ± 0.00358 | | | |

Conclusions:

The extraction of textile grade fibre from both mature and green *Brassica* plants has been established. Some of the textile properties of *Brassica* plant fibre such as moisture regain, decomposition temperature are better than cotton fibre. The fineness of *Brassica* plant fibre is similar to that of cotton. This plant fibre can be dyed using reactive dyes at 50° C.

Example 9: Processing of Textile Fibres

Plant fibre extracted from *Brassica* plant, as described above, was further treated to produce textile fibres and tested for properties suitable for spinning.

Plant fibre was treated as follows:

Treatment Methods:

a) Pectinase Treated and Scoured:

For this treatment method, the pectinase treatment was carried out in a Launder-ometer. The pectinase solution consisted of a mixture of 1% (mL of pectinase in 99 mL of water) having a pH range of 7.5-7.9. Before the start of enzyme treatment, the solution was preheated for 5 minutes at 50° C. to which 0.445 g plant fibre was added. After 120 minutes of enzyme treatment, the samples were removed, washed, and neutralized. The samples were then transferred to watch glass to dry.

Scouring was carried out in a Launder-ometer. The scouring solution consisted of a mixture of tap water (100 mL), AATCC 1993 Standard Detergent (without Optic Brightener), without Phosphate (Test Fabrics, Inc.) (0.20 g), and Wet out solution (4-octylphenol polyethoxylate) (5 drops). 0.2 g of sample plant fibre was treated to give a material liquor ratio of 1:500. Before the start of scouring, the scouring solution was preheated for 5 minutes at 60° C. After 60 minutes of scouring, the samples were removed, washed, and neutralized. The samples were then transferred to watch glass to dry.

b) Pectinase, Scoured, and Bleached:

The same pectinase and scouring treatment protocols were followed as described above. The bleaching solution used included a mixture of hydrogen peroxide (contains inhibitor, 30 wt. % in H2O, ACS reagent [Sigma-Aldrich]) (1 mL), NaOH (ACS reagent, ≥97.0%, pellets (Sigma-Aldrich)) (0.025%), Wet out solution (4-octylphenol polyethoxylate) (5 drops), at a material to liquor ratio of 1:1000.

Scoured samples were used for bleaching. For bleaching, fibre samples were treated in a Launder-o-meter with bleaching solution for 120 minutes at 90° C. After bleaching, fibre samples were rinsed using running tap water and transferred to a watch glass to dry.

c) Scouring, Bleaching, and Reactive Dyeing

The same pectinase, scouring, and bleaching treatment protocols were followed as described above. The dye solution was prepared by combining 0.1 gram of reactive dye to 100 mL water in two Launder-ometer containers, one for mature plant fibre and one for green plant fibre. 1.0 gram of NaCl was then dissolved in 2 mL of water; and 0.25 gram of sodium carbonate was separately dissolved in 1 mL of water.

The dyeing process was conducted in a Launder-ometer. Bleached plant fibre from mature and green *Brassica* were added to respective containers containing preheated water (50° C.) with the dye solution and cycled for 20 minutes (10 minutes to heat solution in container and 10 minutes of optimal dyeing). At the end of the cycle, the sodium chloride solution (1 gram in 2 mL of Tap Water) was added to each Launder-ometer container and cycled for 30 minutes after which sodium bicarbonate solution (0.25 gram in 1 mL of Tap Water) was added to each Launder-ometer container and cycled for another 20 minutes.

The fibres were then treated to an after treatment of a cold water rinse and cycling with a soap solution. The soap solution being a mixture of tap water (90 mL) combined with stock soap solution (10 mL, 1%). The plant fibre samples were then cycled in the Launder-ometer for 10 minutes with the soap solution, rinsed in cold water for 5 minutes, followed by a warm water rinse (60° C.) for 5 minutes then placed on labelled watch glass to dry.

d) Pectinase Treated, Scoured, Bleached, and Blank Dyed:

The same pectinase treatment, scouring treatment, and bleaching treatment was followed as described above. Blank dyeing involved treating the plant fibre with sodium chloride and sodium bicarbonate as followed in the reactive dyeing process, however, during dyeing, the fibre was run blank (no adding dye) for 20 minutes at 50° C. No after treatment was carried out for this plant fibre.

e) Textile Wet Processing Treatment—Alkali and Acid Scouring, and Softening:

Alkali scouring was carried out in a Launder-ometer. The alkali scouring solution consisted of 5.0% NaOH with 0.5% wetting agent. Before the start of scouring, the scouring solution was preheated for 5 minutes at 60° C. After 60 minutes of scouring, the samples were removed, washed, and neutralized. The samples were then transferred to watch glass to dry.

Acid scouring was carried out in a Launder-ometer. The acid scouring solution consisted of 4.0% acetic acid. Before the start of scouring, the scouring solution was preheated for 5 minutes at 60° C. After 30 minutes of scouring, the samples were removed and washed and neutralized. The samples were then transferred to watch glass for softening treatment.

Figure 30:
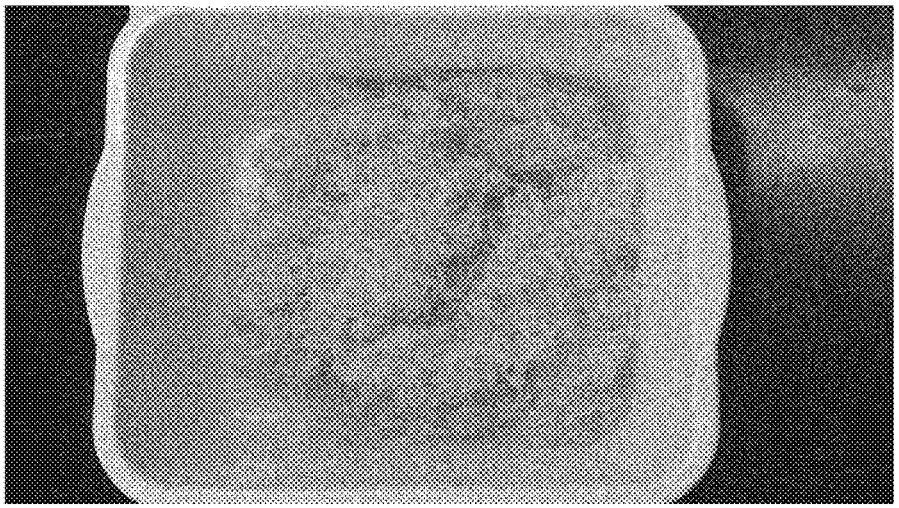
FIG. 30 is a photograph showing *Brassica* plant fibre treated with textile wet processing techniques (alkali and acid scouring, and softening), according to embodiments of the present disclosure.
Figure 31:
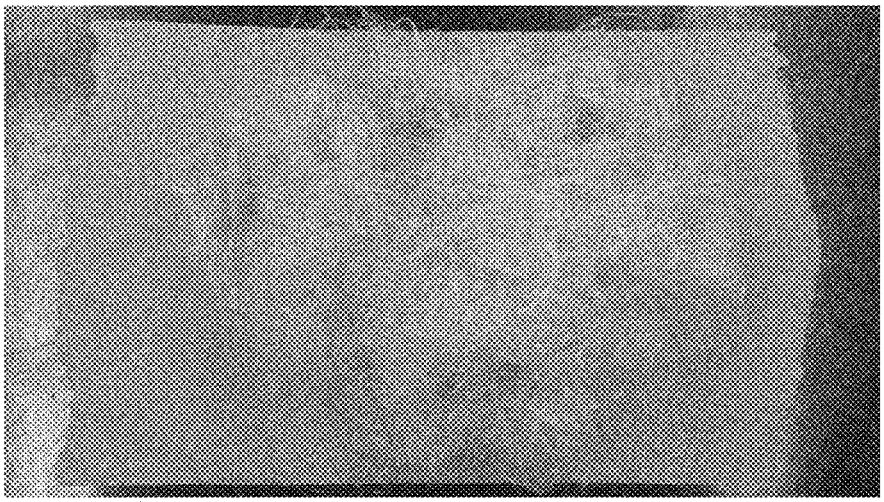
FIG. 31 is a photograph showing *Brassica* plant fibre after treatment with enzymatic processing, according to embodiments of the present disclosure.

Softening was carried out in a Launder-ometer. The softening solution consisted of a 3% Tubingal 4758 solution (CHT Bezema), pH 4.5. Before the start of softening, the Launder-ometer was preheated to 40° C. The softening cycle was completed with a pre-cycle pH of 5.4 and a post-cycle pH of 5.5. The samples were then transferred to watch glass for softening treatment (FIG. 30).

f) Enzymatic Treatment:

The enzymatic process was carried out in a Launder-ometer. The enzymatic solution consisted of a 4% pectinase, pH 5.4 adjusted with acetic acid. Before the start of the cycle, the Launder-ometer was preheated to 40° C. The material to liquor ratio was 1:100 and the enzymatic cycle was completed after 150 minutes with a pre-cycle pH of 5.4 and a post-cycle pH of 5.5. The samples were then transferred to watch glass for softening treatment (FIG. 31).

g) Enhanced Enzymatic Treatment:

The enhanced enzymatic treatment involves a pre-treatment scouring of the samples. The pre-treatment scouring was carried out in a Launder-ometer. The scouring solution consisted of 0.200 g of AATCC 1993 WOB Standard Detergent Without Optic Brightener, Without Phosphate (Testfabrics, Inc.) mixed with 5 drops of wet-out solution ((1% Tx-100) (4-octylphenol polyethoxylate)). Samples are added to this mixture into the Launder-ometer pre-heated to 60° C. The cycle was completed after 60 minutes. The samples were then washed and transferred to watch glass for softening treatment.

Figure 32:
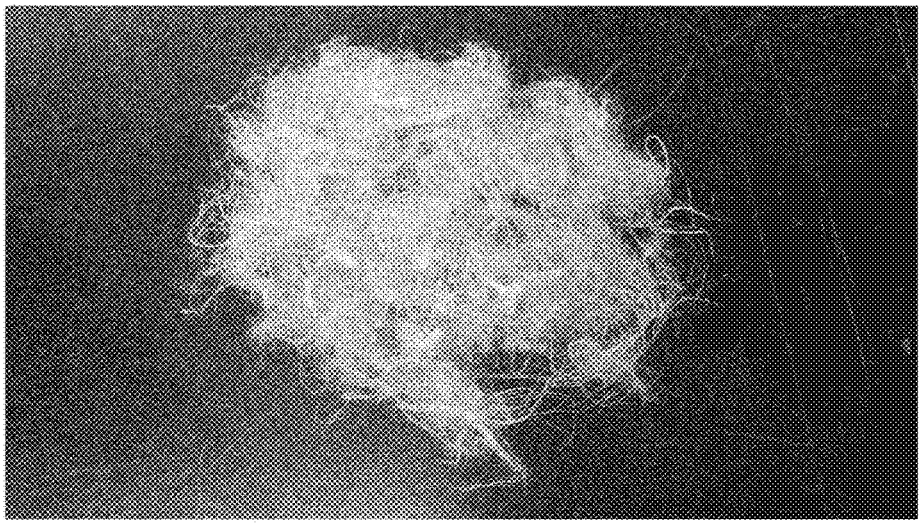
FIG. 32 is a photograph showing *Brassica* plant fibre after treatment with enhanced enzymatic processing, according to embodiments of the present disclosure.

The pre-treated samples were then enzyme treated following the enzymatic treatment process discussed above (FIG. 32).

Example 10: Softness Evaluation

10.1 Softness Evaluation Procedure

Softness of the textile fibres was evaluated for each treatment method. An equal sized sample of each textile fibre was placed into a shallow glass dish and labelled accordingly. All samples were placed in the conditioning room overnight before evaluation. For the evaluation, participants were brought in individually to the evaluation area and instructed to use clean and dry hands to touch each sample making sure not to cross contaminate the textile fibre samples. The participants arranged the textile fibres in the labeled chart from softest (1) to least soft (10) according to participant's sensations from touching the fibres. Sample softness and other relevant properties was determined with reference to the ASTM D123 standard (Table 15). Once all the data was recorded, the positions of all fibres was averaged. Placements were recorded on the given softness scale; lowest average is softest, highest average is least soft. Sum of all recorded participant arrangements for a fibre/# of participants=Average. Other observations made by participants were recorded (comments, questions, concerns).

The textile fibres evaluated included:

Fibre A—Virgin *Brassica* fibres which were produced from *Brassica* plant by water retting as described above without further treatment.

Fibre B: Pectinase (Sigma) and Scouring treatment.

Fibre C—Pectinase (Sigma), Scouring, and Bleaching treatment.

Fibre D—Tap Water—Mature plant fibre, Scouring, Bleaching, and Reactive Dyeing treatment.

Fibre E—Pectinase (Sigma), Scouring, Bleaching, and Blank Dyeing treatment.

Fibre F—Scouring (alkaline and acid), and Softening treatment.

Fibre G—Enzymatic treatment (4.0%, 40° C., 150 minute).

Fibre H—Enhanced enzymatic treatment (4.0%, 40° C., 150 minute, scouring pretreatment).

Fibre I—Cotton, Source: Textile Science Laboratory Manual, University of Arizona, USA.

Fibre J—Polyester, Source: Source: Textile Science Laboratory Manual, University of Arizona, USA.

Fibre K—Flax, Source: Textile Science Laboratory Manual, University of Arizona, USA.

Fibre L—Olefin/Nouvelle®, Source: Textile Science Laboratory Manual, University of Arizona, USA.

Fibre M—Wool, Source: Textile Science Laboratory Manual, University of Arizona, USA.

TABLE 15

Terms Relating to the Hand of Fabrics from ASTM D123-13a: Standard Terminology Relating to Textiles: Terms Relating to the Hand of Fabrics

| Physical Property | Explanatory Phrase | Terms to Be Used in Describing Range of Corresponding Component of Hand |
|---|---|---|
| Flexibility | ease of bending | pliable (high) to stiff (low). |
| Compressibility | ease of squeezing | soft (high) to hard (low). |
| Resilience | ability to recover from deformation | springy (high) to limp (low). Resilience may be flexural, compressional, extensional, or torsional. |
| Surface contour | divergence of the surface from planeness | rough (high) to smooth (low). |

10.2 Fibre Softness Evaluation Results

Fibre softness data is given in Table 16. It can be seen that the softness of virgin *Brassica* fibre was 7.83 which is almost similar to olefin fibre. The three softest fibres were staple (modified for cotton spinning system) polyester (1.0), wool (2.5) and cotton (2.83). It seems that enzyme (pectinase) treatments were not effective to improve the softness for *Brassica* fibres, however, the softness rating was 4.8 when wet processing treatments (scouring, bleaching and reactive dyeing) were applied. This softness rating for treated *Brassica* fibre is much lower than the olefin fibres and slightly higher than the cotton fibre softness.

TABLE 16

Softness data for *Brassica* (virgin) fibre, modified *Brassica* fibre and commonly used textile fibres

| Fibre | Participants 1 | 2 | 3 | 4 | 5 | 6 | 7 | 8 | 9 | 10 | Average | Variance |
|---|---|---|---|---|---|---|---|---|---|---|---|---|
| *Brassica* Fibre A (virgin) | 9 | 7 | 8 | 8 | 7 | 8 | | | | | 7.83 | 0.57 |
| *Brassica* Fibre B (Pectinase (Sigma) Fibre, Scoured) | 8 | 8 | 7 | 7 | 8 | 7 | | | | | 7.5 | 0.30 |
| *Brassica* Fiber C (Pectinase (Sigma) Fibre, Scoured and Bleached) | 10 | 9 | 10 | 10 | 10 | 10 | | | | | 9.83 | 0.17 |
| *Brassica* Fibre D (Tap Water-Scoured, Bleached, and Reactive Dyed) | 5 | 5 | 5 | 5 | 5 | 4 | | | | | 4.83 | 0.17 |
| *Brassica* Fibre E (Pectinase (Sigma) Fibre, Scoured, Bleached, and Blank Dyed, | 6 | 6 | 6 | 6 | 6 | 5 | | | | | 5.83 | 0.17 |
| Fibre F-scoured (alkaline and acid) softened. | 3 | 4 | 3 | 4 | 2 | 2 | | | | | 2.8 | 0.70 |
| Fibre G-4.0% Enzymatic treatment (40° C., 150 minute) | 2 | 2 | 2 | 2 | 2 | 3 | | | | | 2.17 | 0.17 |
| Fibre H-Enhanced enzymatic treatment (4.0%, 40° C., 150 minute), scoured | 2 | 2 | 2 | 3 | 2 | 3 | | | | | 2.3 | 0.27 |
| Fibre I (cotton) | 3 | 3 | 3 | 3 | 2 | 3 | | | | | 2.83 | 0.16 |
| Fibre J (polyester) | 1 | 1 | 1 | 1 | 1 | 1 | | | | | 1.0 | 0.0 |
| Fibre K (Flax) | 4 | 4 | 2 | 4 | 4 | 6 | | | | | 4.0 | 1.6 |
| Fibre L (Olefin/Nouvelle ®) | 7 | 10 | 9 | 9 | 9 | 9 | | | | | 8.3 | 0.97 |
| Fibre M (wool) | 2 | 2 | 4 | 2 | 3 | 2 | | | | | 2.5 | 0.7 |
| Softest (1) | (2) | (3) | (4) | | (5) | (6) | | (7) | | (8) | (9) | Least Soft(10) |

Example 11: Length Variation

Length variation was measured manually using a ruler. For spinning, staple length or span length is the most valuable characteristic of the textile fibre (Lord, E. (1971). Commercial Assessment of Staple length. In Manual of Cotton Spinning—The Characteristics of Raw Cotton, Volume II, Part I, pp 19-32). Other things being equal, in any yarn linear density the longer the fibre the stronger the yarn. For *Brassica* fibre the length was longer than cotton and can be controlled. However, for spinning the length variation in a mixing (blending) lot must be less than 3 mm as spinning machine settings are based on length of fibre.

The length variation of virgin and treated *Brassica* fibres are given in Table 17. It was found that the variation was always <3 mm. This indicates that there was no breakage occurring and the fibre did not shrink during treatments. The immediate conclusion is that length variation of treated *Brassica* fibre is suitable for ring and rotor spinning processes.

TABLE 17

Length variation of virgin and modified *Brassica* fibre

| Treatment type | Length variation (mm) |
|---|---|
| Fibre A: Retted fibre (virgin *Brassica* fibre) | Not applicable |
| Fibre B (Pectinase (Sigma) Fiber, Scoured, | <3.0 |
| Fibre C (Pectinase (Sigma) Fiber, Scoured and Bleached,) | <3.0 |
| Fibre D (Tap Water - Mature, Scoured, Bleached, and Reactive Dyed, | <3.0 |

TABLE 17-continued

Length variation of virgin and modified *Brassica* fibre

| Treatment type | Length variation (mm) |
|---|---|
| Fibre E (Pectinase (Sigma) Fiber, Scoured, Bleached, and Blank Dyed,) | <3.0 |
| Fibre F - scoured (alkaline and acid, softened). | <3.0 |
| Fibre G - 4.0% Enzymatic treatment (40° C., 150 minute) | <3.0 |
| Fibre H - Enhanced enzymatic treatment (4.0%, 40° C., 150 minute), scoured | <3.0 |

Example 12: Single Fibre Entity (Individualization)

12.1 Method

In order to simulate opening and carding actions a Planetary Mono Mill and a laboratory carding machine was used.

Planetary Mono Mill

A Planetary Mono Mill manufactured by Fritsch-Germany was also used to separate the fibre bundles. This machine uses small balls which are placed in a metallic bowl, rotating in a counterclockwise direction. When the bowl rotates the fibers, a beating (grinding) action is performed by the marble balls inside. Due to this beating the bundle is loosened. The maximum feed size is 10 mm while maximum feed quantity is 225 mg.

Card Machine

The Card machine is known as the heart of yarn manufacturing process. One of its functions is fibre to fibre opening. A manual card machine available was used. Although there was no doffer on the machine, however it could perform carding adequately. The fibres were passed through the card machine and operated manually. Some of the small fibres fell down the machine and some were dropped on the other side which was collected while most of them were held in the wires of the cylinder and feed roller which were collected later by using small wooden sticks.

12.2 Results

Figure 33:
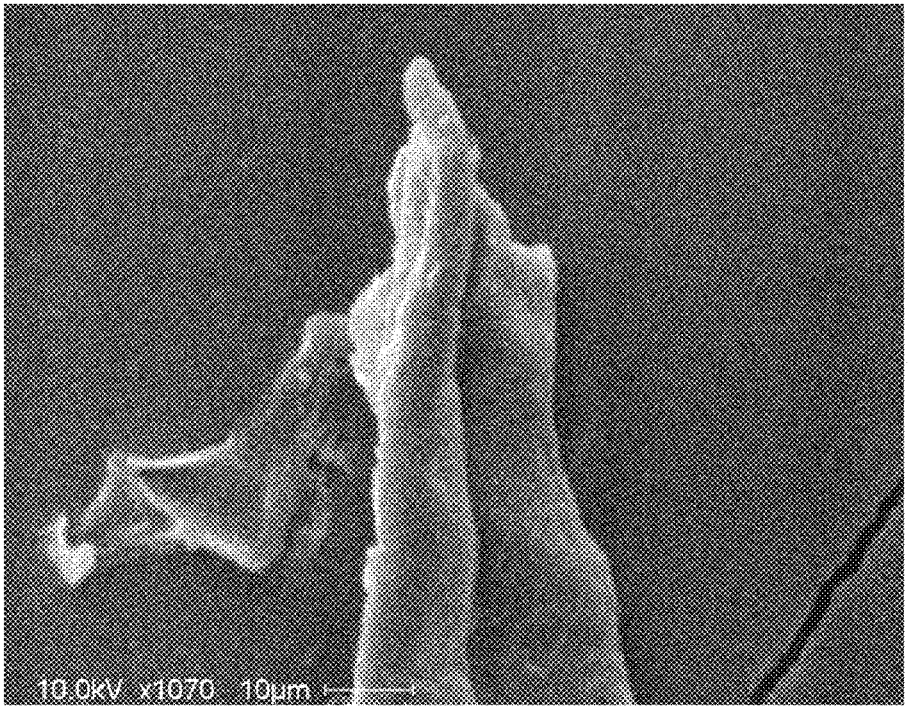
FIG. 33 is a photograph showing the scanning electron microscopy of *Brassica* virgin fibre, according to embodiments of the present disclosure.

The single fibre status of *Brassica* virgin fibres, treated *Brassica* textile fibres and commonly used textile fibres are given in Table 18. The virgin *Brassica* fibres were difficult to separate as the fibres are attached to each other as shown in FIG. 33. However, the ease of separation was improved significantly after treatments and the fibres were separated easily.

TABLE 18

| Single fibre entity | | |
|---|---|---|
| Fibre ID | Single fibre status | comments |
| *Brassica* Fiber A (virgin) | No | Fibres are lumped together and difficult to separate by opening and carding |
| Fibre B (Pectinase (Sigma) Fiber, Scoured) | Yes | Based on ease of separation |
| Fibre C (Pectinase (Sigma) Fiber, Scoured and Bleached | Yes | Based on ease of separation |
| Fibre D (Tap Water - Mature, Scoured, Bleached, and Reactive Dyed, | Yes | Based on ease of separation |
| Fibre E (Pectinase (Sigma) Fiber, Scoured, Bleached, and Blank Dyed,) | Yes | Based on ease of separation |
| Fibre F - scoured (alkaline and acid, softened). | Yes | Based on ease of separation |
| Fibre G - 4.0% Enzymatic treatment (40° C., 150 minute) | Yes | Based on ease of separation |
| Fibre H - Enhanced enzymatic treatment (4.0%, 40° C., 150 minute), scoured | Yes | Based on ease of separation |
| Cotton (Fibre I) | Yes | Based on ease of separation |
| Polyester (Fibre J) | yes | Based on ease of separation |
| Wool (Fibre M) | Yes | Based on ease of separation |
| Olefin (Fibre L) | Yes | Based on ease of separation |

Example 13: Yarn Manufacturing

*Brassica* textile fibres can be used to produce spun yarn by blending with cotton fibres. The textile fibres can further be used to manufacture fabric. Fabric was manufactured with the *Brassica* textile fibres using a modified wet laid method.

The modified wet laid method involved treating *Brassica* plant fibre with a process of scouring, bleaching, and softening, to produce a non-woven *Brassica* fabric. In the alternative, *Brassica* plant fibre was also treated with a process of scouring, and softening, to produce a non-woven *Brassica* fabric.

Processing of *Brassica* Plant Fibre for Non-Woven Fabric Formation

The scouring treatment was carried out in a Launder-ometer. The scouring solution consisted of a mixture of tap water (100 mL), AATCC 1993 Standard Detergent (without Optic Brightener), without Phosphate (Test Fabrics, Inc.) (0.20 g), and Wet out solution (4-octylphenol polyethoxylate) (5 drops). Before the start of scouring, the scouring solution was preheated to 60° C. and had a pre-cycle pH of 10.2-10.4. After 60 minutes of scouring, the samples had a post-cycle pH of 9.8. The treated fibres were then washed with hot tap water for 5 minutes, followed by a second and third hot wash for 10 minutes each in boiling water, neutralized with 1 g/L acetic acid solution at 70° C. for 10 minutes before being transferred to watch glass to dry.

Scoured samples were then treated to bleaching. For bleaching, dried scoured fibre samples were treated in a Launder-o-meter. The bleaching solution used included a mixture of tap water (50 mL), 0.25 g NaOH (ACS reagent, ≥97.0%, pellets (Sigma-Aldrich)) dissolved in 2 mL of tap water, 0.5 mL hydrogen peroxide, Wet out solution (4-octylphenol polyethoxylate) (5 drops), at a material to liquor ratio of 1:300. Once the samples reached 95° C., the cycle was started for 80 (50 minute+30 minute) minutes. When the first 50 minute cycle ended 1% $H_2O_2$ was added to the solution and the cycle completed for the remaining 30 minute bleaching cycle.

Fibres were then rinsed with hot tap water for 5 minutes. The washing was carried out with water at 100° C. for 10 minutes. Subsequently fibres were neutralized with 1 g/l acetic acid at 70° C. for 10 minutes and final was given using cold water. The washed fibre then placed on a labelled watch glass to dry.

Softening was carried out in a Launder-ometer. The softening solution consisted of a 3% Tubingal 4758 solution (CHT Bezema), pH 4.5. Before the start of softening, the Launder-ometer was preheated to 40° C. The softening cycle was completed after 20 minutes with a pre-cycle pH of 5.4 and a post-cycle pH of 5.5. The samples were then washed thoroughly and transferred to watch glass to dry.

Modified Wet Laying Method

Figure 34A:
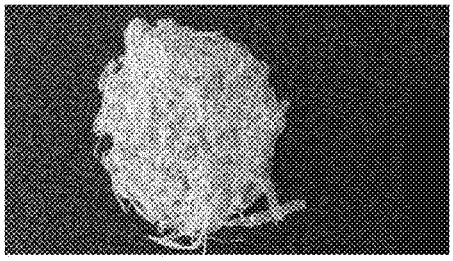
FIG. 34A is a photograph showing non-woven, scoured and softened fabric.
Figure 34B:
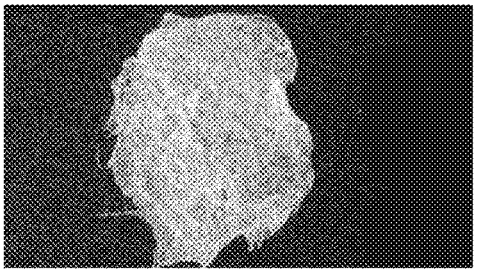
FIGS. 34B and 34C are photographs showing non-woven, scoured, bleached, and softened fabric, according to embodiments of the present disclosure.
Figure 34C:
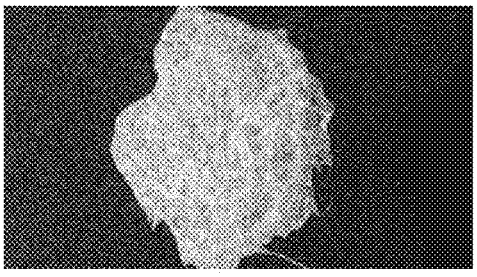

Usually, wet laid non-woven fabric is produced from a random array of layered fibres, with the layering resulting from the deposition of the fibres from water slurry. This method was modified in that the softener treated fibres were transferred into a Buchner Funnel along with the softeners. No washing was given to the fibre samples; however, excess softener solutions were drained through the pores at the bottom of the Buchner Funnel. The formed film of fibres in the resulting non-woven fabric were then transferred to a watch glass and dried at room temperature (FIG. 34).

As a result of the processing treatments, it was found that a gum or glue-like component from the *Brassica* plant fibre is released and remains in the solution. When the treated fibres were dried out, the glue functions as an adhesive to keep the fibre together to form the non-woven fabric. As a result, additional adhesive is not required to form the fabric. This aspect of the textile fibre produced by processing of *Brassica* plant material appears to be distinctive of *Brassica* compared to the other plant fibres.

Conclusions:

Chemical and enzymatic processes have been developed to improve the spinning properties of *Brassica* plant fibres. The chemical process includes scouring, bleaching and reactive dyeing or blank dyeing treatments. These chemical processes are typically used in apparel applications of textiles and, therefore, the processing of *Brassica* textile fibres for apparel applications, according to the present disclosure, would not necessarily require specialized processes.

Summary of spinning properties for *Brassica* and other commonly used textile fibres are given in Table 19. The treated *Brassica* plant fibres exhibit the majority of spinning properties. It is, therefore, concluded that the *Brassica* plant fibres can be further processed using a cotton carding machine to produce non-woven fabrics that are used for many smart textile applications. It is further concluded that the *Brassica* plant fibres have sufficient spinning properties to process using ring and rotor spinning systems.

TABLE 19

Spinning properties of cotton fibre

| Fibre | Fibre Fineness (μm) | Length Variation (mm) | Fibre Strength (g/d) | Single Fibre Entity | Softness |
|---|---|---|---|---|---|
| *Brassica* plant fibre (Fibre A, virgin) | 15.33 | <3.0 | 10.346 | *Yes | *4.83 |
| *Brassica* Fibre (Fibre G, enzymatic treatment) | ~5 | <3.0 | 92.1 cN (breaking force) | Yes | 2.2 |
| Cotton | 16.0-20.0 | <3.0 | 3.0-4.5 | Yes | 2.83 |
| Wool | 14.0-70.0 | <3.0 | 1.0-1.7 | Yes | 2.5 |
| Flax | 40.0-80.0 | Not Available | 5.5-6.5 | No (some fibres are difficult to separate) | 4.0 |
| Polyester | Can be controlled | Can be controlled | 3.0-6.0 (staple grade) | Yes | 1.0 |

*treated *Brassica* fibre;
** value for acetate

The disclosures of all patents, patent applications, publications and database entries referenced in this specification are hereby specifically incorporated by reference in their entirety to the same extent as if each such individual patent, patent application, publication and database entry were specifically and individually indicated to be incorporated by reference.

Although the invention has been described with reference to certain specific embodiments, various modifications thereof will be apparent to those skilled in the art without departing from the spirit and scope of the invention. All such modifications as would be apparent to one skilled in the art are intended to be included within the scope of the following claims.

The embodiments of the invention in which an exclusive property or privilege is claimed are defined as follows:

1. A method for producing textile fibres from *Brassica* plant stems, the method comprising the steps of:

conditioning the *Brassica* plant stems at a temperature of about 21° C. and a relative humidity of about 65%;

retting the conditioned *Brassica* plant stems by submersion in one of water or an alkali solution or an acid solution or an enzyme solution at a temperature selected from the range of about 20° C. to about 40° C. for a period of time selected from the range of 1 day to 5 days to produce bast fibres therefrom;

separating the *Brassica* bast fibres from the retted *Brassica* plant stems;

washing the separated *Brassica* bast fibres; and drying the separated *Brassica* bast fibres, wherein said dried separated *Brassica* bast fibers have a length variation that is less than ±3 mm.

2. The method according to claim 1, wherein said enzyme solution is a 0.1% pectinase enzyme retting solution.

3. The method according to claim 1, wherein the alkali solution is a 0.1% acid retting solution.

4. The method according to claim 1, wherein the acid solution is a 0.1% alkali retting solution.

5. The method according to claim 1, wherein the separated dried *Brassica* fibres are treated with any one of or a combination of treatments selected from the group consisting of enzyme treating, scouring, bleaching, dyeing, and softening.

6. The method according to claim 5, wherein said scouring treatment is an alkali scouring, an acid scouring, or both alkali scouring and acid scouring.

7. The method according to claim 5, wherein said dyeing treatment is with a reactive dye.

8. The method according to claim 5, additionally comprising a step of combining the separated dried *Brassica* fibres with one or more secondary material fibres.

9. The method according to claim 8, wherein the secondary material fibre is a natural fibre or a synthetic fibre or a combination thereof.

* * * * *